US007780275B2

(12) United States Patent
Kusunoki

(10) Patent No.: US 7,780,275 B2
(45) Date of Patent: Aug. 24, 2010

(54) IMAGE FORMING APPARATUS AND DROPLET EJECTION CONTROL METHOD

(75) Inventor: Naoki Kusunoki, Kanagawa (JP)

(73) Assignee: Fujifilm Corporation, Kanagawa (JP)

( * ) Notice: Subject to any disclaimer, the term of this patent is extended or adjusted under 35 U.S.C. 154(b) by 1077 days.

(21) Appl. No.: 11/484,720

(22) Filed: Jul. 12, 2006

(65) Prior Publication Data

US 2007/0013745 A1 Jan. 18, 2007

(30) Foreign Application Priority Data

Jul. 13, 2005 (JP) ..... 2005-204363

(51) Int. Cl.
*B41J 2/06* (2006.01)
*B41J 2/09* (2006.01)
*B41J 2/105* (2006.01)

(52) U.S. Cl. ..... 347/77; 347/9; 347/10; 347/11; 347/12; 347/13; 347/54; 347/55; 347/73; 347/74; 347/76; 347/78; 347/80; 347/81; 347/82

(58) Field of Classification Search ..... 347/9, 347/10, 11, 54, 55, 74, 76, 77, 82
See application file for complete search history.

(56) References Cited

U.S. PATENT DOCUMENTS 6,533,379 B1 * 3/2003 Kubota ..... 347/12
6,623,112 B2 * 9/2003 Yamada et al. ..... 347/74
2005/0062774 A1 * 3/2005 Kusunoki ..... 347/9
2005/0195250 A1 * 9/2005 Kusunoki et al. ..... 347/74
2005/0206683 A1 * 9/2005 Kusunoki ..... 347/55

FOREIGN PATENT DOCUMENTS

JP 6-183129 A 7/1994
JP 2000-177115 A 6/2000
JP 2000-185403 A 7/2000
JP 2002-120361 A 4/2002

* cited by examiner

*Primary Examiner*—Ryan Lepisto
(74) *Attorney, Agent, or Firm*—Birch, Stewart, Kolasch & Birch, LLP

(57) ABSTRACT

In an image forming apparatus, a liquid ejection head has at least one ejection hole, and a conveyor moves a recording medium relative to the ejection head. A deflector deflects liquid droplets ejected from the ejection hole in a direction including at least a component of a direction substantially parallel to relative conveyance direction of the recording medium. A deflection angle setter sets two or more deflection angles such that when dots mutually adjacent in the direction substantially parallel to the relative conveyance direction of the medium are formed in an overlapping fashion, directions of flight of droplets ejected consecutively are deflected such that their directions of flight become different from each other. Droplet landing time differential between the first droplet and the second droplet becomes equal to or greater than quasi-fixing time period from a landing time of the first liquid droplet until the first liquid droplet becomes quasi-fixed.

9 Claims, 18 Drawing Sheets

IMAGE FORMING APPARATUS AND DROPLET EJECTION CONTROL METHOD

BACKGROUND OF THE INVENTION

1. Field of the Invention

The present invention relates to an image forming apparatus and a droplet ejection control method, and more particularly, to droplet ejection control technology for a liquid ejection apparatus which forms, on a medium, a shape such as an image or a prescribed pattern by ejecting a liquid droplet from a ejection hole.

2. Description of the Related Art

In recent years, inkjet printers have come to be used widely as data output apparatuses for outputting images, documents, or the like. By driving recording elements, such as nozzles (ejection holes), provided in a recording head in accordance with data, an inkjet printer is able to form data onto a recording medium by means of ink ejected from the nozzles. In an inkjet printer, a desired image is formed on a medium by ejecting ink droplets from nozzles in a head while the head and a recording medium are caused to move relatively to each other.

Inkjet printers have been used as apparatuses for outputting documents principally in homes and offices, and recently, they have started to be used for outputting images captured by digital cameras, and the like. Furthermore, there are also inkjet apparatuses in which A3 and poster size recording media can be used, and hence they have come to be used for outputting publicity prints, posters, or the like.

In the printing of images captured by means of a digital camera, or the like, good image resolution is an important requirement in image printing, and high-quality image printing is achieved by developments such as multi-color printing, multiple tone gradation, finer dot size, higher dot density, and the like. For example, by using multiple ink colors, such as light inks, it is possible to achieve full color and multiple-stage tone gradation. By increasing the density of the nozzle arrangement and reducing the droplet size, it is possible to increase dot density and reduce dot size in the image. Moreover, if droplet ejection control is performed in order that ink is ejected in such a manner that adjacent dots are mutually overlapping, then the dots can be formed to a high density on the media.

However, when adjacent dots are formed in a mutually overlapping fashion, if the subsequent ink droplet lands before the previously ejected ink has become fixed on the media, then the shape of the dots can be disrupted, and consequently, the subsequently deposited ink droplet can move toward the previously deposited ink droplet. As a result, image abnormalities, such as streaking and non-uniformity, can occur in the image. Furthermore, if inks of different colors are deposited in an overlapping fashion, then color mixing can occur, and consequently it becomes difficult to achieve the desired color and tonal gradation.

In general, in order to prevent image abnormalities caused by streaking or landing interference, a method has been proposed in which droplet ejection is controlled in such a manner that a subsequent ink droplet is ejected after a previously deposited ink droplet has permeated to a certain degree, or a method has been proposed in which a temperature adjustment device is provided for warming a media on which ink has been deposited or warming the ink deposited on a media, the fixing of the ink being accelerated by means of this temperature adjustment device. Furthermore, a method has also been proposed in which an ultraviolet-curable ink whose curing can be promoted by the irradiation of ultraviolet light is used as the ink for forming an image, and the fixing of ink deposited onto a media is promoted accordingly.

Japanese Patent Application Publication No. 6-183129 discloses an inkjet recording method and an inkjet recording apparatus based on an inkjet recording method whereby a plurality of recording heads disposed in a parallel arrangement are moved relatively with respect to a recording medium in order to perform recording. According to the inkjet recording method and inkjet recording apparatus, recording timings are staggered between the recording of either one of the ink dots constituting a border between ink dots of different inks, and the recording of the other ink dot(s), in such a manner that landing interference between different colors is prevented.

Furthermore, Japanese Patent Application Publication No. 2002-120361 discloses the inkjet recording apparatus which comprises a drum for fixing a sheet of paper in position and a plurality of inkjet heads disposed facing the drum at prescribed intervals apart in the circumferential direction of the drum, color printing being performed onto the sheet of paper by driving the inkjet heads while the drum is rotated. In the inkjet recording apparatus, the time T until dots of different colors make contact or overlap mutually at their landing points on the paper satisfies the following relationship, $T \geqq 10$ msec, in such a manner that bleeding is prevented.

Furthermore, Japanese Patent Application Publication No. 2000-177115 discloses a printing method and a print head apparatus in which a charged ink is used, and a channel for ejecting ink is provided between electrodes which generate an electric field. The electric field acts on the ink ejected from the channel and thus deflects the direction of ejection of the ink, in such a manner that image degradation caused by non-uniformities is prevented.

Moreover, Japanese Patent Application Publication No. 2000-185403 discloses an inkjet nozzle, an inkjet recording head, an inkjet cartridge and an inkjet recording apparatus, in which a plurality of heaters that generate air bubbles in ink are provided with respect to each nozzle. By controlling the heaters, different types of bubbles are generated in the ink and hence the direction of flight of the ink can be deflected, in such a manner that landing interference is prevented.

According to the inventions described in Japanese Patent Application Publication No. 6-183129 and Japanese Patent Application Publication No. 2002-120361, high image quality is achieved by preventing bleeding or decline in density, by restricting the landing timings between different colors; however, landing interference between inks of the same color are unresolved, and furthermore there is no improvement in high-speed printing. Furthermore, the inventions described in Japanese Patent Application Publication No. 2000-177115 and Japanese Patent Application Publication No. 2000-185403 relate to technologies for deflecting the direction of flight of ejected ink droplets and thereby preventing image degradation caused by non-uniformities; however, these publications do not disclose or suggest a control method for preventing landing interference or obstacles to such a control method.

SUMMARY OF THE INVENTION

The present invention is conceived in view of the foregoing circumstances, an object thereof being to provide an image forming apparatus and a droplet ejection control method in order that image degradation due to bleeding or landing interference is prevented and satisfactory high-speed printing can be achieved.

In order to attain the aforementioned object, the present invention is directed to an image forming apparatus comprising: a liquid ejection head having at least one ejection hole from which liquid droplets are ejected onto a recording medium; a recording medium conveyance device which causes the liquid ejection head and the recording medium to move relatively to each other, in one direction; a flight direction deflection device which is capable of deflecting directions of flight of the liquid droplets ejected from the ejection hole, in a direction including at least a component of a direction substantially parallel to a relative conveyance direction of the recording medium; and a deflection angle setting device which sets, with respect to the ejection hole, two or more angles of deflection with reference to a normal direction to a surface in which the ejection hole are formed and which is on an ejection side, in such a manner that when dots that are mutually adjacent in the direction substantially parallel to the relative conveyance direction of the recording medium are formed in an overlapping fashion, directions of flight of liquid droplets ejected consecutively from the ejection hole are deflected so that the directions of flight of the liquid droplets ejected consecutively from the ejection hole become different from each other, and a droplet landing time differential between a first liquid droplet and a second liquid droplet which form the dots that are mutually adjacent in the direction substantially parallel to the relative conveyance direction of the recording medium becomes equal to or greater than a quasi fixing time period from a landing time of the first liquid droplet until a time at which the first liquid droplet achieves a quasi fixed state.

According to this aspect of the present invention, the directions of flight of consecutively ejected liquid droplets are deflected in respectively different directions including a component of a direction substantially parallel to the conveyance direction of the recording medium, in such a manner that the droplet landing time differential between the first liquid droplet and the second liquid droplet which form dots that are mutually adjacent in the direction substantially parallel to the conveyance direction of the recording medium is equal to or greater than the quasi fixing time of the first liquid droplet. Therefore, it is possible to avoid landing interference when mutually adjacent dots are formed in an overlapping fashion, and hence degradation of the image quality is suppressed.

There is a mode in which the liquid ejection head comprises pressure chambers that accommodate liquid to be ejected from the ejection holes, and ejection force generating devices which apply an ejection force to the liquid accommodated in the pressure chambers. The ejection pressure generating devices may be actuators which change the volume of the pressure chambers by deforming the pressure chambers, or heaters which generate bubbles inside the pressure chambers by heating the liquid in the pressure chambers.

Furthermore, the liquid ejection head may be a full line head comprising an ejection hole row having a length corresponding to the full width of the recording medium, or a serial type of head which is a short head having an ejection hole row having a length that is shorter than the full width of the recording medium, the head being scanned in the breadthways direction of the recording medium. A line type inkjet head may be formed to a length corresponding to the full width of the recording medium by combining short heads having rows of ejection holes which do not reach a length corresponding to the full width of the recording medium, these short heads being joined together in a staggered matrix fashion.

If the direction substantially parallel to the conveyance direction of the recording medium is taken to be the sub-scanning direction, and the direction substantially perpendicular to the conveyance direction of the recording medium is taken to be the main scanning direction, then if a full line head is used as the liquid ejection head, the direction substantially parallel to the conveyance direction of the recording medium (the sub-scanning direction) corresponds to a breadthways direction of the recording medium, and the direction substantially perpendicular to the conveyance direction of the recording medium (the main scanning direction) corresponds to a direction substantially perpendicular to the breadthways direction of the recording medium. Furthermore, if a shuttle type head is used as the liquid ejection head, then the direction substantially parallel to the conveyance direction of the recording medium (the sub-scanning direction) corresponds to a direction substantially perpendicular to the breadthways direction of the recording medium, and the direction substantially perpendicular to the conveyance direction of the recording medium (the main scanning direction) corresponds to the breadthways direction of the recording medium.

Moreover, the "recording medium" is a medium on which a liquid droplet ejected from an ejection hole is deposited, and this term includes various types of media, irrespective of material and size, such as continuous paper, cut paper, sealed paper, resin sheets such as PHP sheets, film, cloth, and other materials.

The liquid ejected in the form of a droplet from an ejection hole may be an ink used in an inkjet recording apparatus, or a liquid chemical such as resist, a processing solution, or the like. This liquid has properties (viscosity, etc.) which allow it to be ejected from the ejection hole provided in the liquid ejection head.

The quasi fixing time of liquid means the period from the time at which a liquid in the form of a liquid droplet lands on the recording medium until the time the liquid achieve a quasi fixed state, and a quasi fixed state means a state of the liquid droplet where landing interference does not occur, or a state where landing interference may occur but not of a level which affects the quality of the resulting image, if a subsequently deposited liquid droplet makes contact with the previously deposited liquid droplet on the recording medium. Consequently, it is possible to set the angles of deflection on the basis of the fixing time, which is the time until a liquid droplet deposited on the recording medium becomes fully fixed.

The flight direction deflection device may include an electric field generating device which generates an electric field that acts on the charged liquid (liquid droplets). It is possible to use a previously charged liquid as the charged liquid, and it is possible to charge the liquid before applying the electric field, by means of a charging device.

The two or more angles of deflection set for the ejection hole may be set to opposite sides with reference to the normal direction from the liquid droplet ejection surface of the ejection hole (for example, the upstream side and the downstream side with reference to the liquid ejection head, in terms of the conveyance direction of the recording medium), and they may be set to the same side.

If the droplet landing time differential between the first liquid droplet and the second liquid droplet which form dots that are mutually adjacent in the direction substantially parallel to the conveyance direction of the recording medium, is an integral multiple of two or more times a droplet ejection interval, then the synchronization between the control of the angles of deflection and the control of the droplet ejection interval can be simplified, and therefore this mode is preferable.

The "angle of deflection with reference to a normal direction" may include the 0 (zero) degree with reference to the normal direction, and may not include the 0 (zero) degree with reference to the normal direction.

Preferably, if a relationship among a deflection distance y between dots formed on the recording medium by the liquid droplets ejected consecutively from the ejection hole, on a scanning plane in the direction substantially parallel to the relative conveyance direction of the recording medium, a minimum dot pitch Pt between dots formed on the recording medium in the direction substantially parallel to the relative conveyance direction of the recording medium, and a deflection shift amount k on the scanning plane of the liquid droplets ejected consecutively from the ejection hole (where k is an integer equal to or greater than 2), is expressed as $y=k\times Pt$, then the deflection angle setting device determines the deflection shift amount k and sets the angles of deflection for the ejection hole on the basis of the deflection shift amount k, in such a manner that a relationship, on the scanning plane, among the deflection shift amount k, a droplet ejection cycle Tf of the liquid ejection head, and the quasi fixing time To, is expressed as $k \geqq (To/Tf)+1$.

According to this aspect of the present invention, the deflection distance y on the scanning plane of consecutively ejected liquid droplets is k times the minimum dot pitch Pt (where the deflection distance y on the scanning plane of the consecutively ejected liquid droplets is taken to be a distance equivalent to k dots), and the deflection shift amount k is determined in such a manner that the droplet landing time differential on the recording medium between consecutively ejected droplets (the landing time differential, in other words, the time period taken for the recording medium 16 to move by the dot pitch $(k-1)\times Pt$) becomes equal to or greater than the quasi fixing time To. Consequently, even if the quasi fixing time To of the liquid varies, due to the type of recording medium or the type of liquid, the deflection shift amount k is obtained on the basis of values of the quasi fixing time To and the droplet ejection cycle Tf corresponding to the type of recording medium and the type of liquid, the angles of deflection for the ejection hole are set accordingly, and it is possible to maintain high image quality, regardless of the type of recording medium or the type of liquid.

Taking the distance between the liquid ejection surface and the image formation surface of the recording medium to be Z, the direction of flight of the liquid droplets (the angle of deflection with reference to the vertical direction) θ is given by $\theta=\arctan(y/Z)$.

Preferably, the angles of deflection set for the ejection hole include an angle having a component toward an upstream side with reference to the liquid ejection head in the direction substantially parallel to the relative conveyance direction of the recording medium, and an angle having a component toward an downstream side with reference to the liquid ejection head in the direction substantially parallel to the relative conveyance direction of the recording medium.

According to this aspect of the present invention, the directions of flight of the liquid droplets ejected consecutively from the ejection hole are deflected alternately to the upstream side and the downstream side in the conveyance direction of the recording medium. Hence, it is possible to increase the deflection shift amount stated above, and therefore, it is possible to reliably prevent landing interference between liquid droplets which form mutually adjacent dots.

The absolute value of the angle of deflection to the upstream side in the conveyance direction of the recording medium, and the absolute value of the angle of deflection to the downstream side in the conveyance direction of the recording medium may be the same value or they may be different values.

Preferably, the liquid ejection head comprises a plurality of the ejection holes aligned in a direction substantially perpendicular to the relative conveyance direction of the recording medium; and the deflection angle setting device sets the angles of deflection with respect to the ejection holes in such a manner that the angles of deflection for the ejection holes that are mutually adjacent in the direction substantially perpendicular to the relative conveyance direction of the recording medium, are different from each other.

According to this aspect of the present invention, different angles of deflection are set for ejection holes that are mutually adjacent in the direction substantially perpendicular to the conveyance direction of the recording medium, and the liquid droplets ejected at the same timing from the adjacent ejection holes from which droplets are ejected to form mutually adjacent dots land in positions which are separated from each other by a prescribed distance in the direction substantially parallel to the conveyance direction of the recording medium. Consequently, landing interference is avoided between liquid droplets which form dots that are mutually in the direction substantially perpendicular to the conveyance direction of the recording medium, the degradation of the image quality is prevented, and hence even better image quality can be achieved.

Modes where there are a plurality of ejection holes aligned in the direction substantially perpendicular to the conveyance direction of the recording medium include a mode where a head comprises one ejection hole row including a plurality of ejection holes aligned in one row in the direction substantially parallel to the conveyance direction of the recording medium, and a mode where a head comprises two ejection hole rows in which the ejection holes are arranged in a staggered matrix configuration.

Preferably, the deflection angle setting device sets the angles of deflection for the ejection holes from which the liquid droplets are ejected to form the dots that are mutually adjacent in the direction substantially perpendicular to the relative conveyance direction of the recording medium in such a manner that, a relationship between an absolute value $|\theta a\mathbf{1}|$ of an angle $\theta a\mathbf{1}$ of deflection to an upstream side in the relative conveyance direction of the recording medium, set for a first ejection hole of the ejection holes from which the liquid droplets are ejected to form the dots that are mutually adjacent in the direction substantially perpendicular to the relative conveyance direction of the recording medium, and an absolute value $|\theta b\mathbf{2}|$ of an angle $\theta b\mathbf{2}$ of deflection to a downstream side in the relative conveyance direction of the recording medium, set for a second ejection hole of the ejection holes from which the liquid droplets are ejected to form the dots that are mutually adjacent in the direction substantially perpendicular to the relative conveyance direction of the recording medium, satisfies the following equation: $|\theta a\mathbf{1}|=|\theta b\mathbf{2}|$; and a relationship between an absolute value $|\theta a\mathbf{2}|$ of an angle $\theta a\mathbf{2}$ of deflection to the downstream side in the relative conveyance direction of the recording medium set for the first ejection hole, and an absolute value $|\theta b\mathbf{1}|$ of an angle $\theta b\mathbf{1}$ of deflection to the upstream side in the relative conveyance direction of the recording medium set for the second ejection hole, satisfies the following equation: $|\theta a\mathbf{2}|=|\theta b\mathbf{1}|$.

According to this aspect of the present invention, it is possible to simplify the control of the flight direction deflection device which deflects the direction of flight of liquid droplets, thus helping to reduce the burden on the control system.

Preferably, the deflection angle setting device sets a droplet ejection position shift amount S relating to a relationship L=Pt×S among a deflection distance L in the direction substantially parallel to the relative conveyance direction of the recording medium between dots formed by liquid droplets landing at substantially simultaneously from the ejection holes in two dot rows which are adjacent in a direction substantially perpendicular to the relative conveyance direction of the recording medium, a minimum dot pitch Pt in the direction substantially parallel to the relative conveyance direction of the recording medium between the dots formed on the recording medium, and a droplet ejection position shift amount S (where S is an integer equal to or greater than 2), and sets the angles of deflection for the ejection holes according to the droplet ejection position shift amount S, in such a manner that a droplet landing time differential between the liquid droplets which form the dots that are mutually adjacent on the recording medium in the direction substantially perpendicular to the relative conveyance direction of the recording medium, becomes equal to or greater than the quasi fixing time of a precedent one of the liquid droplets.

According to this aspect of the present invention, the droplet ejection position shift amount S is set in such a manner that the droplet landing time differential between liquid droplets which form dots that are mutually adjacent in a direction substantially perpendicular to the conveyance direction of the recording medium becomes the quasi fixing time of the liquid droplets. Consequently, it is possible to reliably avoid landing interference between liquid droplets which land on the medium at substantially the same timing in the two dot rows that are mutually adjacent in the direction substantially perpendicular to the conveyance direction of the recording medium.

Preferably, the deflection angle setting device sets the droplet ejection position shift amount S and sets the angles of deflection for the ejection holes according to the droplet ejection position shift amount S in such a manner that the droplet landing time differential between the liquid droplets which form dots that are mutually adjacent in an oblique direction which is different from the directions substantially parallel to and substantially perpendicular to the relative conveyance direction of the recording medium, becomes equal to or greater than the quasi fixing time of the precedent one of the liquid droplets.

According to this aspect of the present invention, the droplet ejection position shift amount S is set in such a manner that the droplet landing time differential between liquid droplets forming dots that are mutually adjacent in an oblique direction is equal to or greater than the quasi fixing time of the liquid droplets, and the angles of deflection are set accordingly. Consequently, it is possible to avoid landing interference between liquid droplets which form dots that are mutually adjacent in the oblique direction, and hence even better image quality can be achieved.

In order to attain the aforementioned object, the present invention is also directed to a method of controlling droplet ejection in an image forming apparatus including a liquid ejection head, the method of controlling droplet ejection comprising the steps of: performing a relative movement between the liquid ejection head and a recording medium in one direction; and ejecting liquid droplets from at least one ejection hole provided in the liquid ejection head while the relative movement between the liquid ejection head and the recording medium is performed in such a manner that a desired image is formed on the recording medium, wherein two or more angles of deflection with reference to a normal direction to a surface in which the ejection hole are formed and which is on an ejection side are set with respect to the ejection hole, in such a manner that when dots that are mutually adjacent in a direction substantially parallel to a relative conveyance direction of the recording medium are formed in an overlapping fashion, a direction of flight of at least one of liquid droplets ejected consecutively from the ejection hole is deflected so that directions of flight of the liquid droplets ejected consecutively from the ejection hole become different from each other, and a droplet landing time differential between a first liquid droplet and a second liquid droplet which form the dots that are mutually adjacent in the direction substantially parallel to the relative conveyance direction of the recording medium becomes equal to or greater than a quasi fixing time period from a landing time of the first liquid droplet until a time at which the first liquid droplet achieves a quasi fixed state.

According to the present invention, a direction of flight of consecutively ejected liquid droplets are deflected in respectively different directions including a component of a direction substantially parallel to a conveyance direction of a recording medium, in such a manner that the droplet landing time differential between a first liquid droplet and a second liquid droplet which form dots that are mutually adjacent in the direction substantially parallel to the conveyance direction of the recording medium is equal to or greater than a quasi fixing time of the first liquid droplet. Therefore, it is possible to avoid landing interference when mutually adjacent dots are formed in an overlapping fashion, and hence degradation of the image quality is suppressed. Moreover, different angles of deflection are set for ejection holes which eject liquid droplets to form dots that are mutually adjacent in the direction substantially perpendicular to the conveyance direction of the recording medium, and the liquid droplets ejected at the same timing from the adjacent ejection holes land in positions which are separated from each other by a prescribed distance in the direction substantially parallel to the conveyance direction of the recording medium. Consequently, landing interference is avoided between liquid droplets which form dots that are mutually adjacent in the direction substantially perpendicular to the conveyance direction of the recording medium, the degradation of the image quality is prevented, and hence even better image quality can be achieved. Moreover, since the droplet landing time differential between liquid droplets which form dots that are mutually adjacent in the oblique direction is equal to or greater than the quasi fixing time of the liquid, it is possible to prevent landing interference between liquid droplets forming dots that are mutually adjacent in the oblique direction and hence even better image quality can be achieved.

BRIEF DESCRIPTION OF THE DRAWINGS

The nature of this invention, as well as other objects and benefits thereof, will be explained in the following with reference to the accompanying drawings, wherein.

DETAILED DESCRIPTION OF THE PREFERRED EMBODIMENTS

General Composition of Inkjet Recording Apparatus

Figure 1:
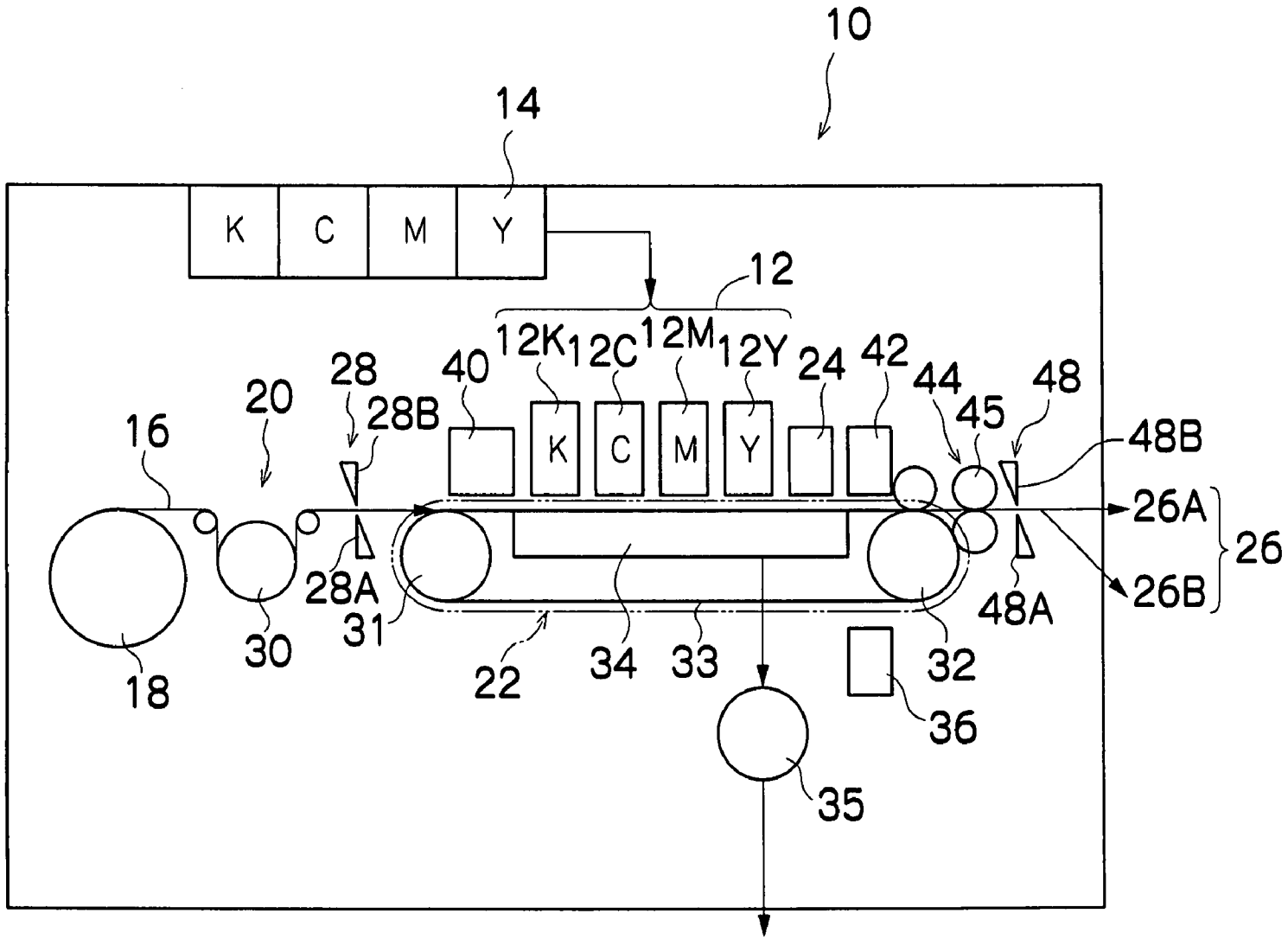
FIG. 1 is a general schematic drawing of an inkjet recording apparatus relating to an embodiment of the present invention.

FIG. 1 is a diagram of the general composition of an inkjet recording apparatus according to an embodiment of the present invention. As shown in FIG. 1, the inkjet recording apparatus 10 comprises: a printing unit 12 having a plurality of print heads 12K, 12C, 12M, and 12Y for ink colors of black (K), cyan (C), magenta (M), and yellow (Y), respectively; an ink storing and loading unit 14 for storing inks of K, C, M and Y to be supplied to the print heads 12K, 12C, 12M, and 12Y; a paper supply unit 18 for supplying recording medium (recording paper) 16; a decurling unit 20 for removing curl in the recording medium 16; a suction belt conveyance unit 22 disposed facing the nozzle face (ink-droplet ejection face) of the print unit 12, for conveying the recording medium 16 while keeping the recording medium 16 flat; a print determination unit 24 for reading the printed result produced by the printing unit 12; and a paper output unit 26 for outputting printed recording medium 16 (printed matter) to the exterior.

In FIG. 1, a magazine for rolled paper (continuous paper) is shown as an embodiment of the paper supply unit 18; however, a plurality of magazines with papers of different paper width and quality may be jointly provided. Moreover, papers may be supplied in cassettes that contain cut papers loaded in layers and that are used jointly or in lieu of magazines for rolled papers.

In the case of a configuration in which a plurality of types of recording medium can be used, it is preferable that an information recording medium such as a bar code and a wireless tag containing information about the type of medium is attached to the magazine, and by reading the information contained in the information recording medium with a predetermined reading device, the type of the medium to be used is automatically determined, and ink-droplet ejection is controlled (droplet ejection control is performed) so that the ink-droplets are ejected in an appropriate manner in accordance with the type of medium.

The recording medium 16 delivered from the paper supply unit 18 retains curl due to having been loaded in the magazine. In order to remove the curl, heat is applied to the recording medium 16 in the decurling unit 20 by a heating drum 30 in the direction opposite to the curl direction in the magazine. At this time, the heating temperature is preferably controlled in such a manner that the recording paper 20 has a curl in which the surface on which the print is to be made is slightly rounded in the outward direction.

In the case of the configuration in which roll paper is used, a cutter (a first cutter) 28 is provided as shown in FIG. 1, and the roll paper is cut into a desired size by the cutter 28. The cutter 28 has a stationary blade 28A of which length is not less than the width of the conveyor pathway of the recording medium 16, and a round blade 28B which moves along the stationary blade 28A. The stationary blade 28A is disposed on the reverse side of the printed surface of the recording medium 16, and the round blade 28B is disposed on the printed surface side across the conveyance path. When cut paper is used, the cutter 28 is not required.

After decurling, the cut recording medium 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the print unit 12 and the sensor face of the print determination unit 24 forms a flat plane.

The belt 33 has a width that is greater than the width of the recording medium 16, and a plurality of suction openings (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as shown in FIG. 1; and a negative pressure is generated by sucking air from the suction chamber 34 by means of a fan 35, thereby the recording medium 16 on the belt 33 is held by suction.

The belt 33 is driven in the clockwise direction in FIG. 1 by the motive force of a motor (not shown in FIG. 1, but shown as a motor 88 in FIG. 6) being transmitted to at least one of the rollers 31 and 32, which the belt 33 is set around, and the recording medium 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, embodiments thereof include a configuration in which the belt 33 is nipped with a brush roller and a water absorbent roller, an air blow configuration in which clean air is blown onto the belt 33, or a combination of these. In the case of the configuration in which the belt 33 is nipped with the cleaning roller, it is preferable to make the linear velocity of the cleaning roller different to that of the belt 33, in order to improve the cleaning effect.

Instead of a suction belt conveyance unit 22, it might also be possible to use a roller nip conveyance mechanism; however, since the printing area passes through the roller nip, the printed surface of the recording medium 16 makes contact with the rollers immediately after printing, and hence smearing of the image is liable to occur. Therefore, a suction belt conveyance mechanism in which nothing comes into contact with the image surface in the printing area is preferable.

A heating fan 40 is provided before the print unit 12 in the recording medium conveyance path formed by the suction belt conveyance unit 22. This heating fan 40 blows heated air onto the recording medium 16 before printing, and thereby heats up the recording medium 16. By heating the recording medium 16 immediately before printing, ink dries more readily after landing on the paper.

Figure 2:
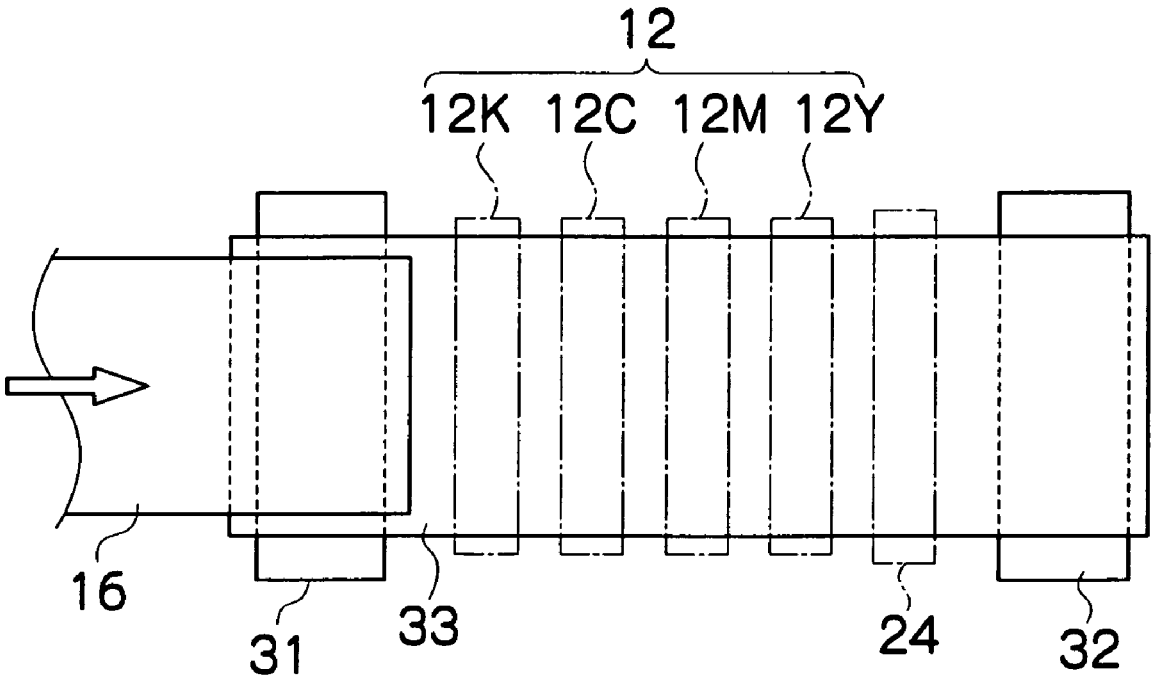
FIG. 2 is a principal plan diagram of the peripheral area of a print unit in the inkjet recording apparatus illustrated in FIG. 1.

The print unit 12 is a so-called "full line head" in which a line head having a length corresponding to the maximum paper width is arranged in a direction (main scanning direction) that is perpendicular to the recording medium conveyance direction (see FIG. 2). An embodiment of the detailed structure is described below (in FIG. 3 to FIG. 5), but each of the print heads 12K, 12C, 12M, and 12Y is constituted by a line head, in which a plurality of ink ejection ports (nozzles) are arranged along a length that exceeds at least one side of the maximum-size recording medium 16 intended for use in the inkjet recording apparatus 10, as shown in FIG. 2.

The print heads 12K, 12C, 12M, and 12Y are arranged in the order of black (K), cyan (C), magenta (M), and yellow (Y) from the upstream side, in the feed direction of the recording medium 16 (hereinafter, referred to as the recording medium conveyance direction). A color image can be formed on the recording medium 16 by ejecting the inks from the print heads 12K, 12C, 12M, and 12Y, respectively, onto the recording medium 16 while the recording medium 16 is conveyed.

The print unit 12, in which the full-line heads covering the entire width of the paper are thus respectively provided for the ink colors, can record an image over the entire surface of the recording medium 16 by performing the action of moving the recording medium 16 and the print unit 12 relatively to each other in the sub-scanning direction just once (in other words, by means of a single sub-scan). Higher-speed printing is thereby made possible and productivity can be improved in comparison with a shuttle type head configuration in which a print head moves reciprocally in the main scanning direction.

Although a configuration with four standard colors, K M C and Y, is described in the present embodiment, the combinations of the ink colors and the number of colors are not limited to these, and light and/or dark inks can be added as required. For example, a configuration is possible in which print heads for ejecting light-colored inks such as light cyan and light magenta are added.

As shown in FIG. 1, the ink storing and loading unit 14 has ink tanks for storing the inks of the colors corresponding to the respective print heads 12K, 12C, 12M, and 12Y, and the respective tanks are connected to the print heads 12K, 12C, 12M, and 12Y by means of channels (not shown). The ink storing and loading unit 14 has a warning device (for example, a display device or an alarm sound generator) for warning when the remaining amount of any ink is low, and has a mechanism for preventing loading errors among the colors.

The print determination unit 24 has an image sensor for capturing an image of the ink-droplet deposition result by the printing unit 12, and functions as a device to check for ejection defects such as clogs of the nozzles in the printing unit 12 from the ink-droplet deposition results evaluated by the image sensor.

The print determination unit 24 of the present embodiment is configured with at least a line sensor having rows of photoelectric transducing elements with a width that is greater than the ink-droplet ejection width (image recording width) of the print heads 12K, 12C, 12M, and 12Y. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

The print determination unit 24 reads a test pattern image printed by the print heads 12K, 12C, 12M, and 12Y for the respective colors, and the ejection of each print head is determined. The ejection determination includes the presence of the ejection, measurement of the dot size, and measurement of the dot deposition position.

A post-drying unit 42 is disposed following the print determination unit 24. The post-drying unit 42 is a device to dry the printed image formation surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substances that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image formation surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathways in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly before the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown in FIG. 1, the paper output unit 26A for the target prints is provided with a sorter for collecting prints according to print orders.

Description of Structure of Print Head

Next, the structure of a print head is described below. The print heads 12K, 12C, 12M and 12Y, which are respectively provided for ink colors, have the same structure, and a reference numeral 50 is hereinafter designated to any of the print heads.

In this embodiment, a paper medium is described as the recording medium onto which ink droplets are ejected by the inkjet recording apparatus 10. However, besides a paper medium, it is also possible to use various other types of recording media, such as a metallic plate, resin plate, wood, cloth, leather, or the like, which is capable of fixing ink thereto, can be conveyed relatively to the print head 50, and can maintain a clearance with respect to the print head 50.

Figure 3:
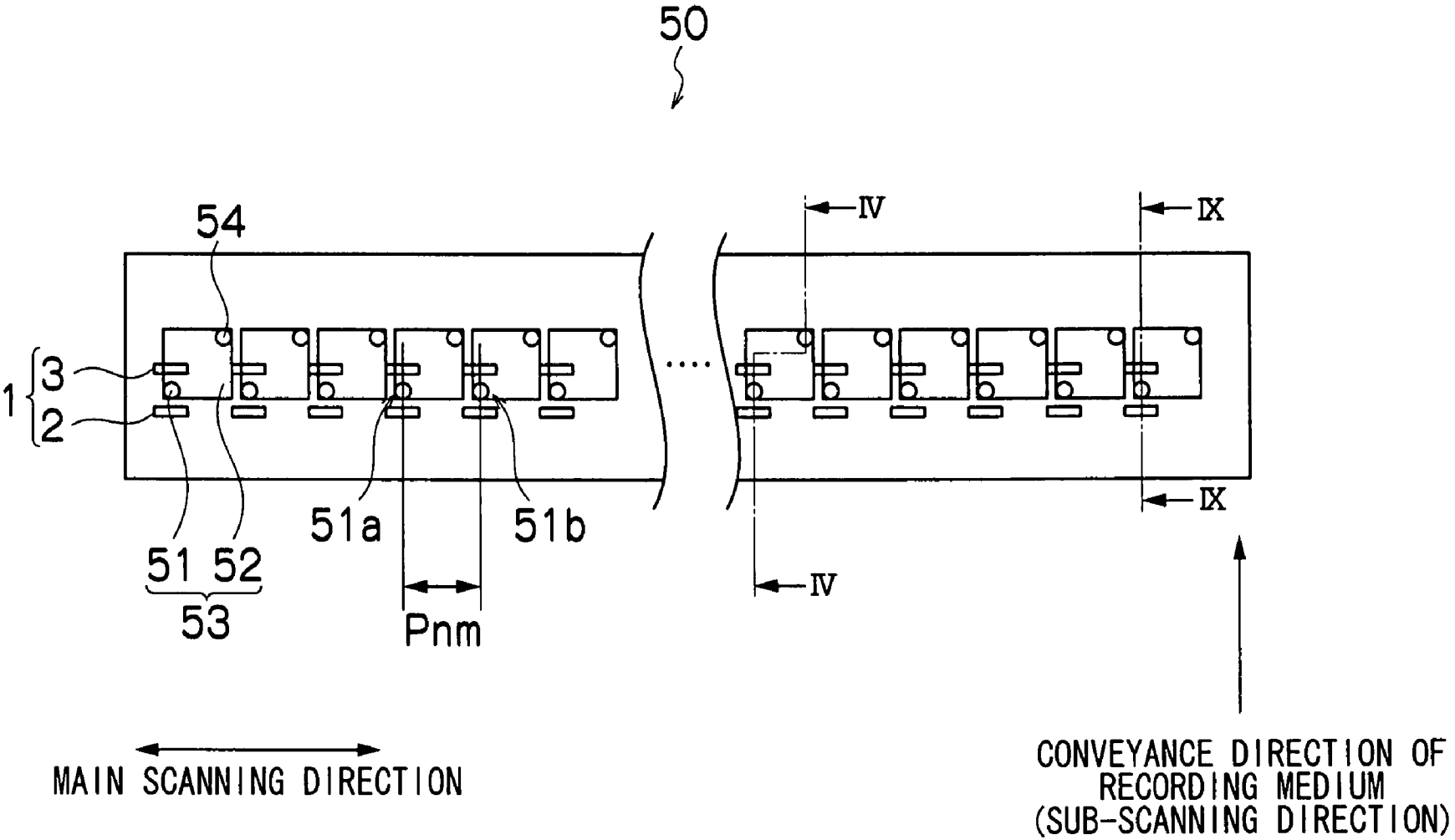
FIG. 3 is a plan view perspective diagram showing an embodiment of the composition of a print head.
Figure 4:
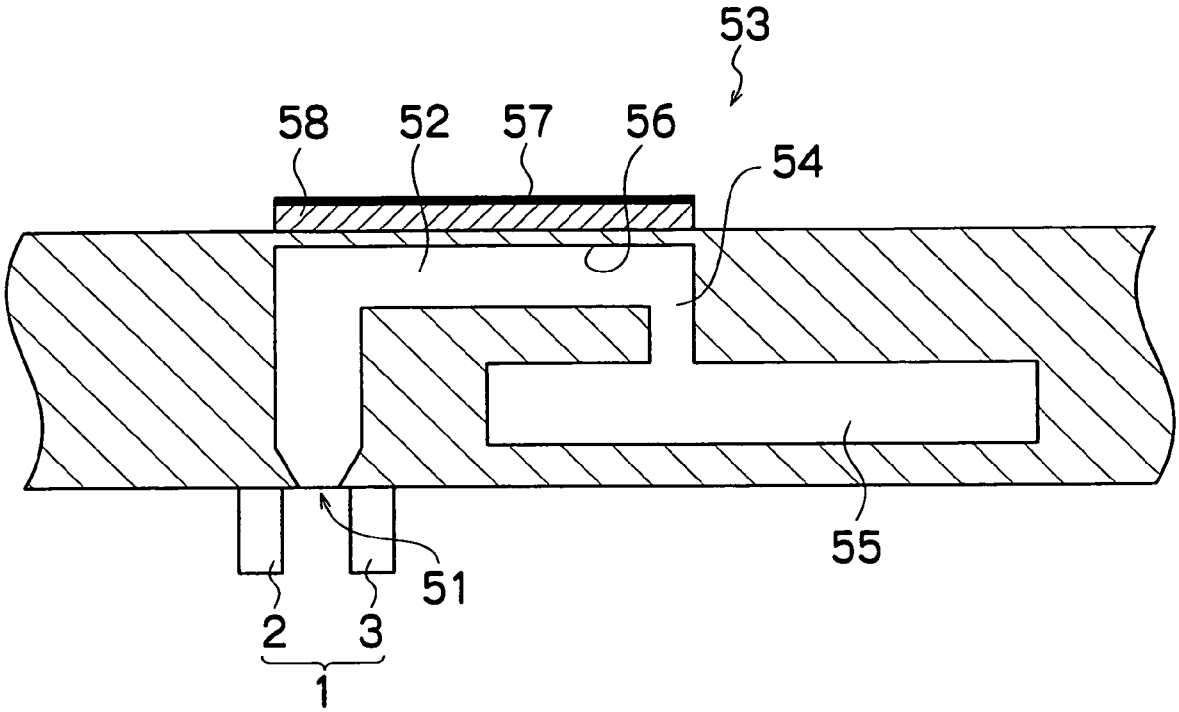
FIG. 4 is a cross-sectional diagram along line IV-IV in FIG. 3.

FIG. 3 is a plan view perspective diagram showing an embodiment of the structure of a print head 50, and FIG. 4 is a cross-sectional diagram showing the three-dimensional composition of an ink chamber unit (a cross-sectional view along line IV-IV in FIG. 3).

As shown in FIG. 3, the print head 50 according to the present embodiment has a structure in which a plurality of ink chamber units 53, each comprising a nozzle 51 from which an ink droplet is ejected, a pressure chamber 52 corresponding to the nozzle 51, and the like, are arranged in a line in the main scanning direction. The print head 50 forms a full line head having one nozzle row in which the plurality of nozzles 51 (ink chamber units 53) are arranged through a length corresponding to the full width of the recording medium 16 in the main scanning direction, which is substantially perpendicular to the conveyance direction of the recording medium. In the nozzle row of the print head 50, the nozzles 51 constituting the nozzle row are aligned equidistantly at a nozzle pitch Pnm (for example, the distance between nozzle 51*a* and nozzle 51*b*).

The present embodiment is described with respect to a piezo jet method in which an ejection force is applied to the ink inside the pressure chamber 52 by deforming the pressure chamber 52 through driving an actuator 58; however, it is also possible to adopt a thermal method in which a heater is provided inside the pressure chamber 52 and an ejection force is applied to the ink inside the pressure chamber 52 by driving the heater and thus generating a bubble inside the pressure chamber 52.

An electrically charged ink containing charged particles having a positive (or negative) electrical charge is used in the inkjet recording apparatus 10 described in the present embodiment. If the electric field generated between an electrode pair 1 is applied to droplets of charged ink ejected from the nozzles 51, then the direction of flight of the droplets of the charged ink is deflected to a direction which is displaced by a prescribed angle from a vertical direction (namely, the direction of the normal to the ink ejection side of the nozzles 51).

The electrode pair 1 provided for each nozzle is constituted by an electrode 2 and an electrode 3 aligned in a substantially parallel direction to the conveyance direction of the recording medium (sub-scanning direction), and the electrode 2 and the electrode 3 are provided opposing each other on either side of the nozzle 51.

For a method of deflecting the direction of flight of the ink droplets, it is possible to use a method described in Japanese Patent Application Publication No. 2000-177115, in which the direction of flight of ink droplets is deflected by imparting an electrical charge to the ink (or using charged ink) and causing an electric field to act on the space through which the ink droplets are propelled. Alternatively, it is possible to use the method described in Japanese Patent Application Publication No. 2000-185403, in which a plurality of bubble-generating heaters are provided in the sub-scanning direction at each nozzle, and the direction of flight .of the ink is deflected by switching these heaters on and off, selectively. It is also possible to adopt a commonly known method other than the above for deflecting the direction of flight of the ink. The details of controlling the deflection of the flight direction of the ink droplets ejected from the nozzles 51 are described below.

For the charged ink droplets ejected from the nozzles 51, it is possible to use previously charged ink, or alternatively, a charging unit may be provided in the ink flow channels and a charging processing may be performed inside the apparatus (inside the head).

As shown in FIG. 3, the planar shape of the pressure chambers 52 provided corresponding to the respective nozzles 51 is substantially a square shape, a nozzle 51 and a supply port 54 being provided in respective corner sections on a diagonal of the planar shape, and each of the pressure chambers 52 being connected to the common flow channel 55 shown in FIG. 4, via the supply port 54.

As shown in FIG. 4, an actuator 58 provided with an individual electrode 57 is joined to a pressure plate 56 which forms the upper face of the pressure chamber 52, and the actuator 58 is deformed when a drive voltage is supplied to the individual electrode 57, thereby causing ink to be ejected from the nozzle 51. After the ink is ejected, new ink is supplied to the pressure chamber 52 from the common flow passage 55, via the supply port 54. Incidentally, a piezoelectric element (piezoelectric actuator), such as PZT (lead titanate zirconate) and PVDF (polyvinylidene fluoride), is used as the actuator 58 provided in the print head 50 shown in this embodiment.

In the present embodiment, a full line print head 50 having a nozzle row of a length corresponding to the full width of the recording medium 16 is described; however, the present invention may also be applied to a shuttle scanning (serial) system in which an image is formed over a prescribed range in the breadthways direction of the recording medium 16 by scanning a short head having a length which is shorter than the full width of the recording medium 16 in the breadthways direction of the recording medium 16, and an image is formed over the whole surface of the recording medium 16 by performing the aforementioned image formation action while the recording medium 16 is conveyed in a direction perpendicular to the scanning direction of the short head. In the shuttle scanning system, the breadthways direction of the recording medium 16 (the scanning direction of the short head) corresponds to the main scanning direction, and the direction of arrangement of the nozzle row provided in the short head corresponds to the sub-scanning direction.

Description of Ink Supply System

Figure 5:
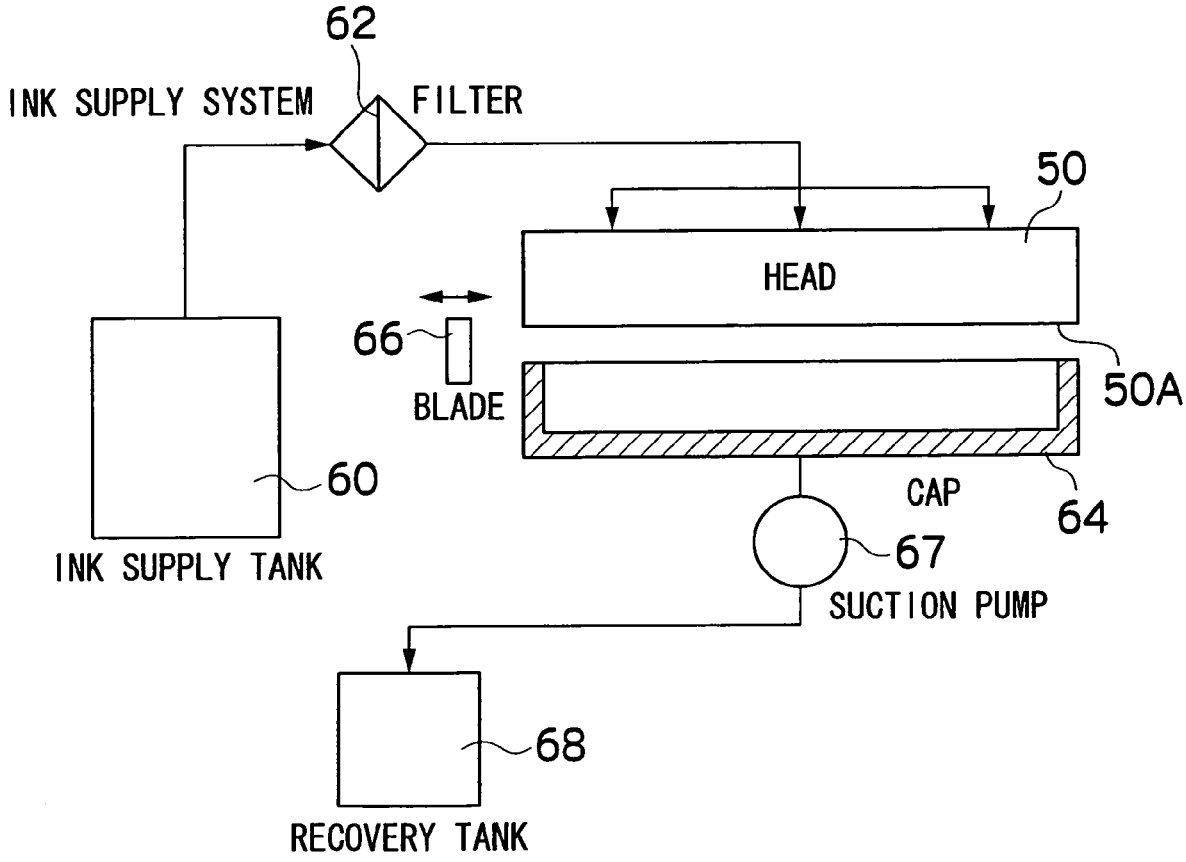
FIG. 5 is a conceptual diagram showing the composition of an ink supply system in the inkjet recording apparatus shown in FIG. 1.

FIG. 5 is a schematic drawing showing the configuration of the ink supply system in the inkjet recording apparatus 10.

The ink supply tank 60 is a base tank that supplies ink and is set in the ink storing and loading unit 14 described with reference to FIG. 1. The embodiments of the ink supply tank 60 include a refillable type and a cartridge type: when the remaining amount of ink is low, the ink supply tank 60 of the refillable type is filled with ink through a filling port (not shown) and the ink supply tank 60 of the cartridge type is replaced with a new one. In order to change the ink type in accordance with the intended application, the cartridge type is suitable, and it is preferable to represent the ink type information with a bar code or the like on the cartridge, and to perform ejection control in accordance with the ink type.

A filter 62 for removing foreign matters and bubbles is disposed between the ink supply tank 60 and the print head 50 as shown in FIG. 5. The filter mesh size in the filter 62 is preferably equivalent to or less than the diameter of the nozzle and commonly about 20 μm.

Although not shown in FIG. 5, it is preferable to provide a sub-tank integrally to the print head 50 or nearby the print head 50. The sub-tank has a damper function for preventing variation in the internal pressure of the head and a function for improving refilling of the print head.

The inkjet recording apparatus 10 is also provided with a cap 64 as a device to prevent the nozzles 51 from drying out or to prevent an increase in the ink viscosity in the vicinity of the nozzles 51, and a cleaning blade 66 as a device to clean the nozzle face.

A maintenance unit including the cap 64 and the cleaning blade 66 can be relatively moved with respect to the print head 50 by a movement mechanism (not shown), and is moved from a predetermined holding position to a maintenance position below the print head 50 as required.

The cap 64 is displaced up and down relatively with respect to the print head 50 by an elevator mechanism (not shown). When the power of the inkjet recording apparatus 10 is turned OFF or when a print state is a standby state, the cap 64 is raised to a predetermined elevated position so as to come into close contact with the print head 50, and the nozzle face 50A is thereby covered with the cap 64.

During printing or standby, if the use frequency of a particular nozzle 51 is low, and if a state of not ejecting ink continues for a prescribed time period or more, then the solvent of the ink in the vicinity of the nozzle evaporates and the viscosity of the ink increases. In a situation of this kind, it is difficult to eject ink from the nozzle 51, even if the actuator 58 is operated.

Therefore, before a situation of this kind develops (namely, while the ink is within a range of viscosity which allows it to be ejected by operation of the actuator 58), the actuator 58 is operated, and a preliminary ejection ("purge", "blank ejection", "liquid ejection" or "dummy ejection") is carried out toward the cap 64 (ink receptacle), in order to expel the degraded ink (namely, the ink in the vicinity of the nozzle which has increased viscosity).

Furthermore, if air bubbles enter into the ink inside the print head 50 (inside the pressure chamber 52), then even if the actuator 58 is operated, it is difficult to eject ink from the nozzle. In a case of this kind, the cap 64 is placed on the print head 50, the ink (ink containing air bubbles) inside the pressure chamber 52 is removed by suction, by means of a suction pump 67, and the ink removed by suction is then supplied to a recovery tank 68.

This suction operation is also carried out in order to remove degraded ink having increased viscosity (hardened ink), when ink is loaded into the head for the first time, and when the head starts to be used after having been out of use for a long period of time. Since the suction operation is carried out with respect to all of the ink inside the pressure chamber 52, the ink consumption is considerably large. Therefore, desirably, preliminary ejection is carried out when the increase in the viscosity of the ink is still minor.

The cleaning blade 66 is composed of rubber or another elastic member, and can slide on the ink ejection surface (surface of the nozzle plate) of the print head 50 by means of a blade movement mechanism (wiper) which is not shown. When ink droplets or foreign matter has adhered to the nozzle plate, the surface of the nozzle plate is wiped and cleaned by sliding the cleaning blade 66 on the nozzle plate. Incidentally, when the soiling on the ink ejection surface is cleaned away by the blade mechanism, a preliminary ejection is carried out in order to prevent the foreign matter from becoming mixed inside the nozzle 51 by the blade.

Description of System Control System

Figure 6:
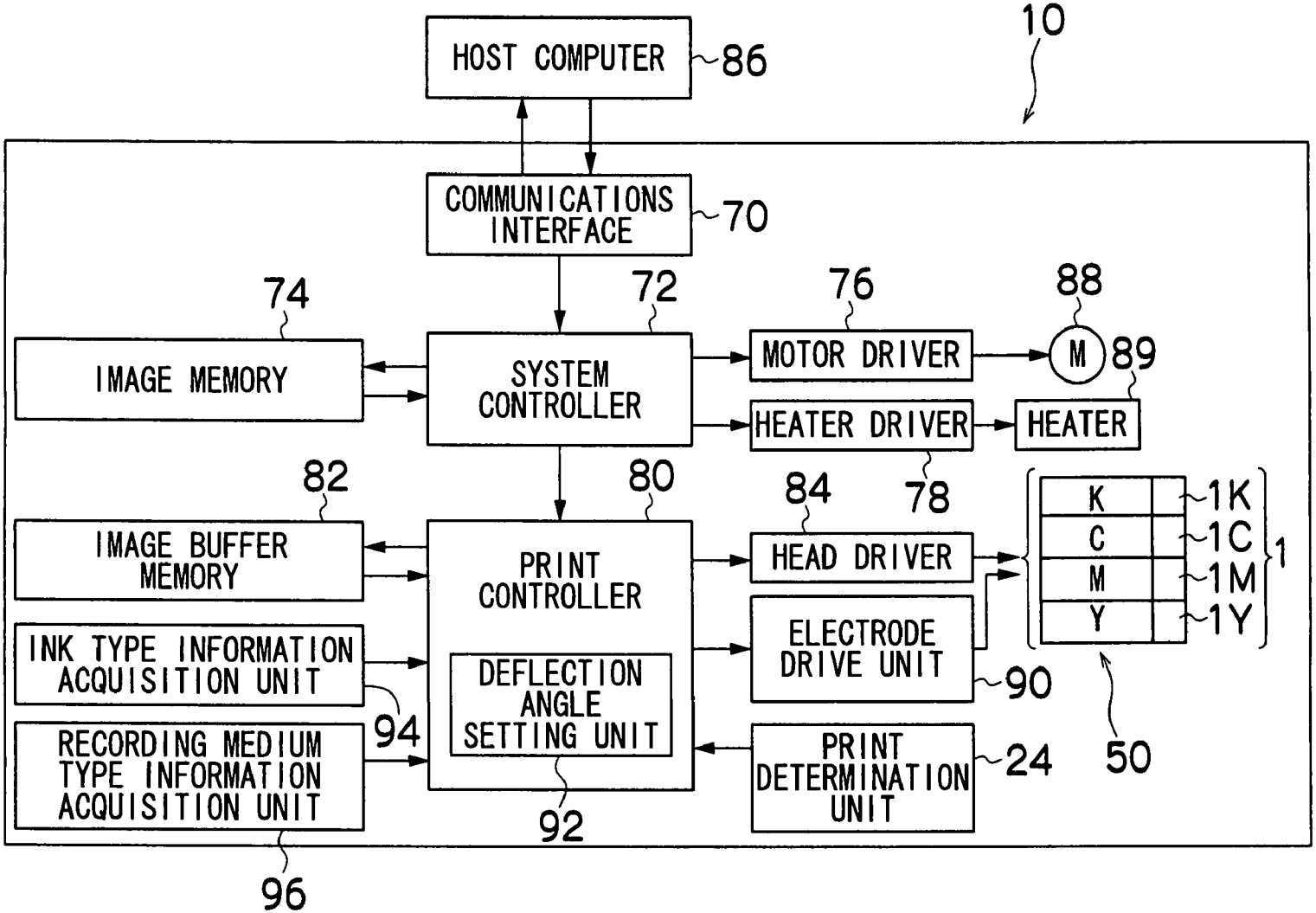
FIG. 6 is a principal block diagram showing the system configuration of the inkjet recording apparatus shown in FIG. 1.

FIG. 6 is a principal block diagram showing the system configuration of the inkjet recording apparatus 10. The inkjet recording apparatus 10 comprises a communication interface 70, a system controller 72, a memory 74, a motor driver 76, a heater driver 78, a print controller 80, an image buffer memory 82, a head driver 84, and the like.

The communication interface 70 is an interface unit for receiving image data sent from a host computer 86. A serial interface such as USB (Universal Serial Bus), IEEE1394, Ethernet (registered trademark), wireless network, or a parallel interface such as a Centronics interface may be used as the communication interface 70. A buffer memory (not shown) may be mounted in this portion in order to increase the communication speed. The image data sent from the host computer 86 is received by the inkjet recording apparatus 10 through the communication interface 70, and is temporarily stored in the memory 74. The memory 74 is a storage device for temporarily storing images inputted through the communication interface 70, and data is written and read to and from the memory 74 through the system controller 72. The memory 74 is not limited to a memory composed of semiconductor elements, and a hard disk drive or another magnetic medium may be used.

The system controller 72 is a control unit for controlling the various sections, such as the communications interface 70, the memory 74, the motor driver 76, the heater driver 78, and the like. The system controller 72 is constituted by a central processing unit (CPU) and peripheral circuits thereof, and the like, and in addition to controlling communications with the host computer 86 and controlling reading and writing from and to the memory 74, or the like, it also generates a control signal for controlling the motor 88 of the conveyance system and the heater 89.

The motor driver (drive circuit) 76 drives the motor 88 in accordance with commands from the system controller 72. The heater driver (drive circuit) 78 drives the heater 89 of the post-drying unit 42 or the like in accordance with commands from the system controller 72.

The print controller 80 has a signal processing function for performing various tasks, compensations, and other types of processing for generating print control signals from the image data stored in the memory 74 in accordance with commands from the system controller 72 so as to supply the generated print control signal (print data) to the head driver 84. Prescribed signal processing is carried out in the print controller 80, and the ejection amount and the ejection timing of the ink droplets from the respective print heads 50 are controlled via the head driver 84 (ejection control), on the basis of the print data. By this means, prescribed dot size and dot positions can be achieved.

The print controller 80 is provided with the image buffer memory 82; and image data, parameters, and other data are temporarily stored in the image buffer memory 82 when image data is processed in the print controller 80. The embodiment shown in FIG. 6 is one in which the image buffer memory 82 accompanies the print controller 80; however, the memory 74 may also serve as the image buffer memory 82. Also possible is an embodiment in which the print controller 80 and the system controller 72 are integrated to form a single processor.

The print controller 80 includes an deflection angle setting unit 92 which sets the directions of electric fields generated by the electrode pairs 1 (1K, 1C, 1M, 1Y) provided at the nozzles 51, via the electrode drive unit 90. More specifically, the direction of flight of the ink droplets ejected from the nozzles 51 on the basis of the print data is deflected through an angle of deflection determined by the deflection angle setting unit 92.

More specifically, the intensity and the directions of the electric fields generated by the electrode pairs 1 are determined on the basis of information relating to the angles of deflection set by the deflection angle setting unit 92, and the electrode pairs 1 corresponding to the nozzles 51 are driven by the electrode drive unit 90 on the basis of this electric field intensity and electric field directions.

The deflection angle setting unit 92 sets an angle of deflection of ink by referring to the ink type information obtained from the ink type information acquisition unit 94, and information on the recording medium 16 obtained from a recording medium type information acquisition unit 96. A composition may be adopted in which the ink type information and the information on the recording medium 16 are read out from an information storage body attached to the ink cartridge or the stocker (tray) for a recording medium 16, and a composition may also be adopted in which an operator inputs the information by means of a user interface (man-machine interface), such as a keyboard, mouse, touch panel, or the like.

The head driver 84 drives the actuators 58 of the print heads of the respective colors 12K, 12C, 12M and 12Y on the basis of print data supplied by the print controller 80. The head driver 84 can include a feedback control system for maintaining constant drive conditions for the print heads.

Various control programs are stored in a program storage section (not illustrated), and a control program is read out and executed in accordance with commands from the system controller 72. A semiconductor memory, such as a ROM, EEPROM, or a magnetic disk, or the like may be used as the program storage section. An external interface may be provided, and a memory card or a PC card may also be used. Naturally, two or more media of these storage media may also be provided. The program storage section may also serve as a storage device for storing operational parameters, and the like (not shown).

The print determination unit 24 is a block that includes the line sensor as described above with reference to FIG. 1, reads the image printed on the recording medium 16, determines the print conditions (presence of the ejection, variation in the dot formation, and the like) by performing required signal processing, and the like, and provides the determination results of the print conditions to the print controller 80.

According to requirements, the print controller 80 makes various corrections (compensations) with respect to the print head 50 on the basis of information obtained from the print determination unit 24.

Description of Droplet Ejection Control

Next, droplet ejection control in the inkjet recording apparatus 10 is described below. In the inkjet recording apparatus 10 according to the present embodiment, in order to achieve high density in a recorded image, dots formed on the recording medium 16 by the ink droplets ejected consecutively from the nozzles 51 are formed in such a manner that the dots which are mutually adjacent in the main scanning direction (the direction substantially perpendicular to the recording medium conveyance direction) and in the sub-scanning direction (the recording medium conveyance direction, or a direction substantially parallel to the recording medium conveyance direction) overlap with each other. Even if dots are formed at high density and high speed in this way, the ejection of ink droplets is controlled in such a manner that the occurrence of dot abnormalities due to landing interference is prevented.

Figure 7:
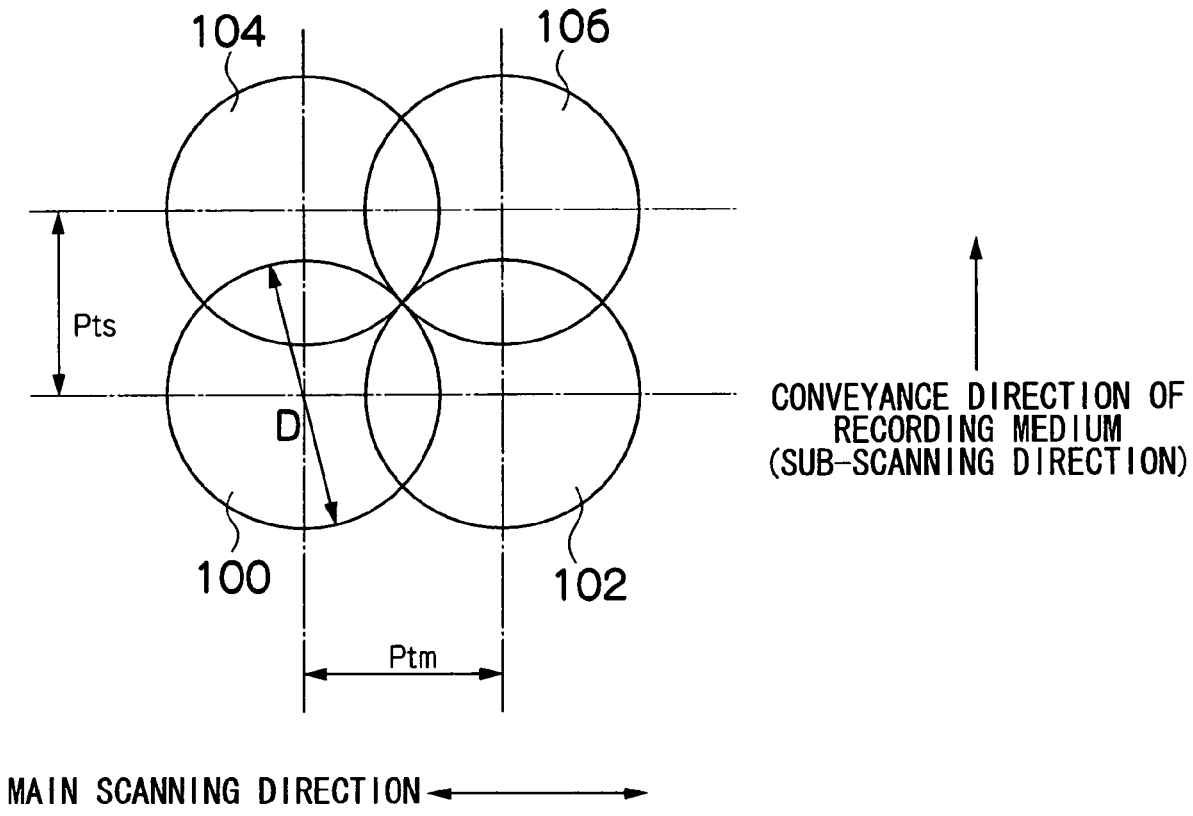
FIG. 7 is a diagram illustrating a dot arrangement formed by the inkjet recording apparatus shown in FIG. 1.

FIG. 7 shows dots formed in such a manner that dots which are mutually adjacent in the main scanning direction and the sub-scanning direction overlap with each other. As shown in FIG. 7, dots 100, 102, 104 and 106 formed on the recording medium 16 by the ink droplets ejected from the print head 50 are formed in such a manner that the dots which are adjacent in the main scanning direction and the dots which are adjacent in the sub-scanning direction are partially overlapping.

In other words, the dot 100 is formed so as to overlap partially with the dot 102, which is adjacent in the main scanning direction, and the dot 100 is also formed so as to overlap partially with the dot 104, which is adjacent in the sub-scanning direction. Furthermore, the dot 100 is also formed so as not to overlap with the dot 106 which is adjacent in the diagonal direction, and hence there is no overlap between the dot 100 and the dot 106.

Four dots formed by ink droplets ejected onto the recording medium 16 are shown in FIG. 7; however, the actual image is constituted by a plurality of dots, and the dots satisfy the positional relationships of the dots 100 to 106 shown in FIG. 7. Furthermore, in this droplet ejection control, dots arranged in one row in each of the main scanning direction, sub-scanning direction or oblique direction are arranged in such a manner that dots positioned on either side of any particular dot do not overlap with each other. In other words, the dots are formed in such a manner that three or more dots do not overlap with each other in a set of dots arranged in one row in the main scanning direction or the sub-scanning direction. For example, although not shown in the drawings, a dot is also formed on the opposite side of the dot 104 from the dot 100, in the main scanning direction (on the upper side of the dot 104 (i.e., above the dot 104) in FIG. 7), but no part of the dot above the dot 104 overlaps with the dot 100. Similarly, a dot is formed on the opposite side of the dot 100 from the dot 102 (the left-hand side of the dot 100 in FIG. 7), but no part of the dot to the left-hand side of the dot 100 overlaps with the dot 100.

In other words, taking the dot pitch in the main scanning direction to be Ptm, the dot pitch in the sub-scanning direction to be Pts (where Ptm=Pts=Pt), and the diameter of the dot formed (hereinafter, called the "dot size") to be D, the dots 100, 102, 104 and 106 shown in FIG. 7 have the relationship indicated in the following equation (Formula 1).

$$D=Pt\times 2^{1/2} \quad \text{(Formula 1)}$$

Figure 8:
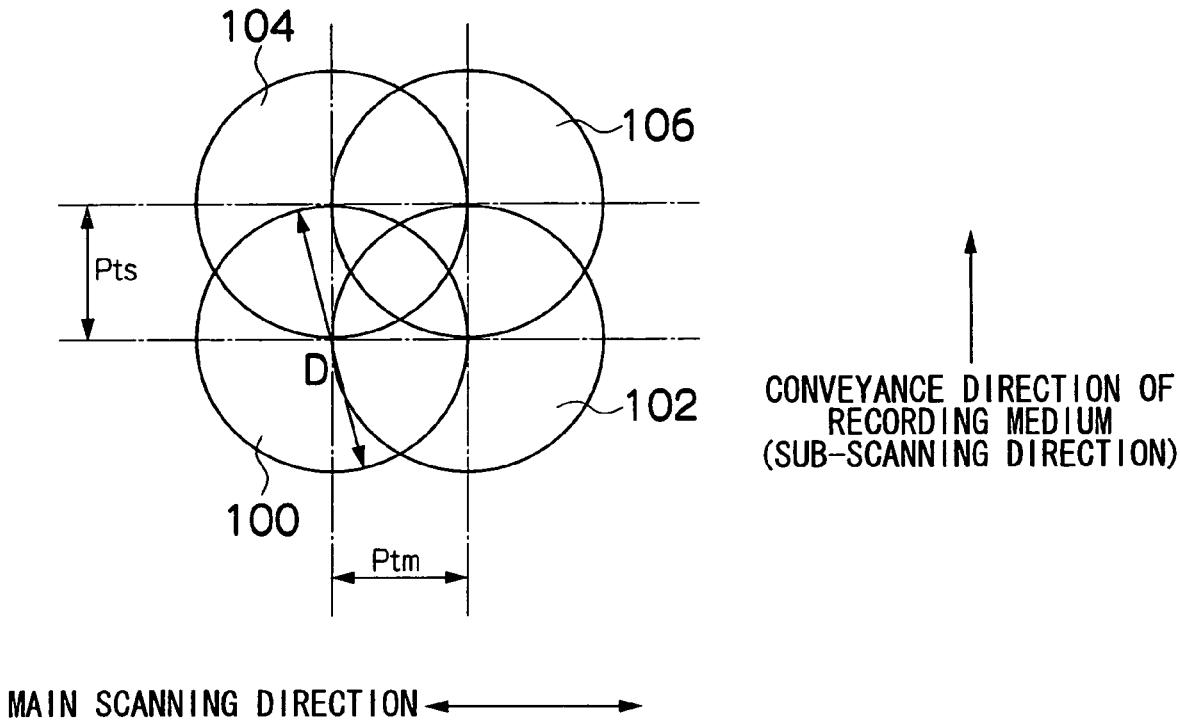
FIG. 8 is a diagram showing a further mode of a dot arrangement shown in FIG. 7.

FIG. 8 shows an embodiment in which dots are formed at higher density in comparison with the embodiment shown in FIG. 7. In the embodiment shown in FIG. 8, the dot pitch between adjacent dots is smaller than in the embodiment shown in FIG. 7.

More specifically, in the embodiment shown in FIG. 8, dots which are mutually adjacent in main scanning direction and dots which are mutually adjacent in the sub-scanning direction are formed so as to overlap with each other, and furthermore, dots which are mutually adjacent in an oblique direction, which is different than the main scanning direction and the sub-scanning direction, are formed so as to overlap with each other. More specifically, a dot 100 is formed in such a manner that it overlaps partially with a dot 102 which is adjacent in the main scanning direction, a dot 104 which is adjacent in the sub-scanning direction, and a dot 106 which is adjacent in the oblique direction. The dot pitch Ptm in the main scanning direction, the dot pitch Pts in the sub-scanning direction (where Ptm=Pts=Pt), and the dot diameter D of the dots 100, 102, 104 and 106 formed in this fashion, have a relationship indicated by the following equation, (Formula 2).

$$D=Pt\times 2 \quad \text{(Formula 2)}$$

Here, the arrangement of the dots is determined in such a manner that the dot 100, for instance, does not overlap with the dots formed so as to overlap with the adjacent dots which are located on either side of the dot 100 (in other words, does not overlap with the dots formed on the opposite sides of the dots adjacent to dot 100 from the dot 100). In the droplet ejection control described in the present embodiment, the dot arrangement shown in FIG. 8 may be used as a dot arrangement in which dots for forming a recorded image are arranged at high density, in high-quality mode, for instance. The dot arrangement shown in FIG. 7 may be used for a recorded image in which the dot density is reduced to some extent, as in a high-speed printing mode, for instance.

Next, the droplet ejection control relating to the present embodiment (and in particular, the droplet ejection control for forming dots arranged at high density as shown in FIG. 8, at high speed) is described below.

Figure 9:
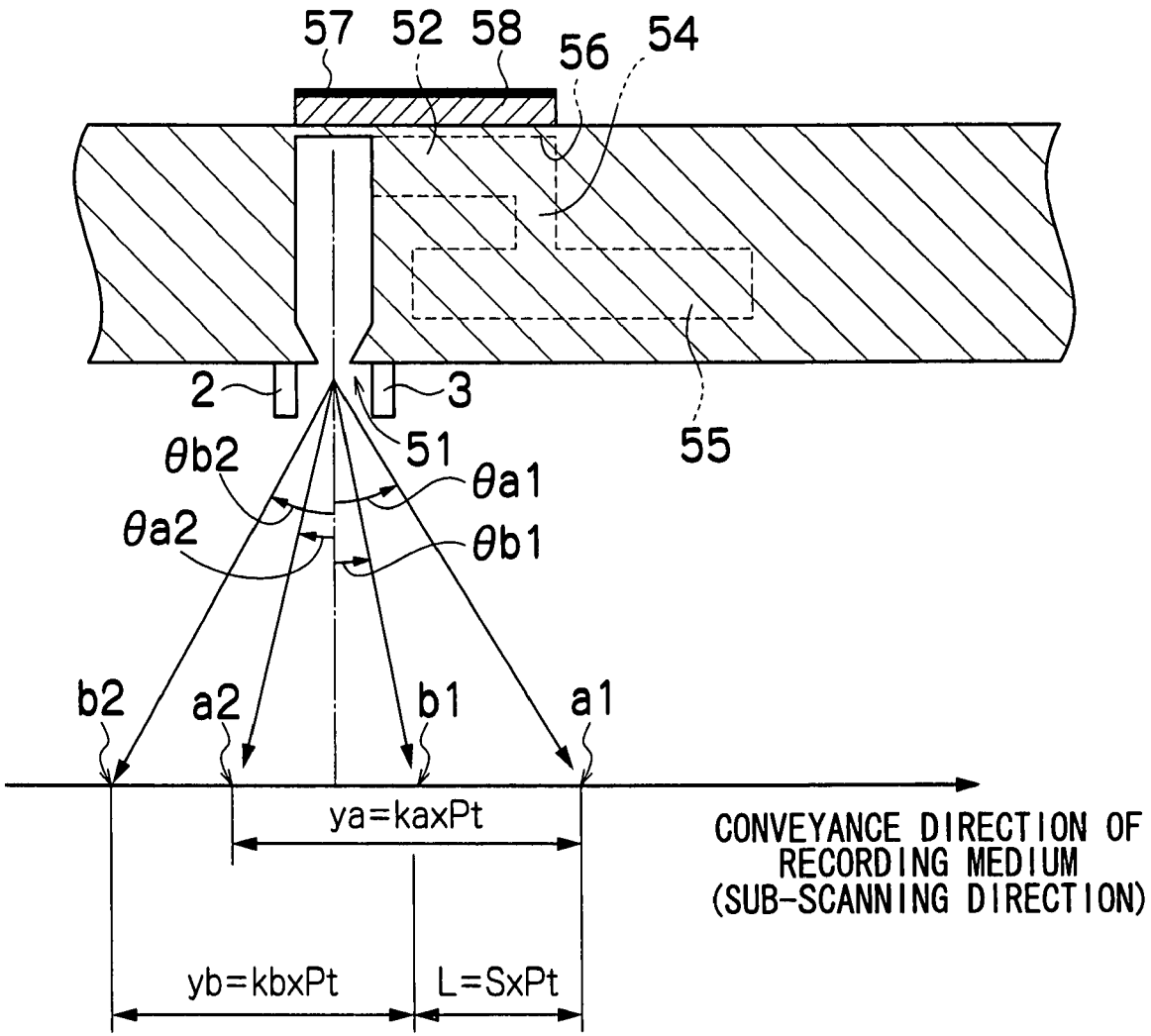
FIG. 9 is a diagram showing the deflection of the direction of flight of the ink droplets ejected from the print head of the inkjet recording apparatus shown in FIG. 1.

As shown in FIG. 9, in the inkjet recording apparatus 10 according to the present embodiment, two types of angles of deflection are set for each nozzle 51, and furthermore, different angles of deflection are set between nozzles which are mutually adjacent in the main scanning direction (nozzles which eject ink droplets to form dots that are mutually adjacent in the main scanning direction). For example, the angles θa1 and θa2 shown in FIG. 9 are the angles of deflection set for nozzle 51*a* in FIG. 3 and the angles θb1 and θb2 are the angles of deflection set for nozzle 51*b* in FIG. 3.

More specifically, the angles of deflection θa1, θa2, θb1 and θb2 shown in FIG. 9 are determined in such a manner that the differential between the droplet ejection times of ink droplets forming dots that are mutually adjacent in the main scanning direction (a direction substantially perpendicular to the conveyance direction of the recording medium) is equal to or greater than a prescribed time, while the droplet landing time differential (droplet ejection interval) between the ink droplets which form dots that are mutually adjacent in the sub-scanning direction (conveyance direction of recording medium) is taken account of.

In the case of nozzle 51*a* and nozzle 51*b* which are mutually adjacent in the main scanning direction (see FIG. 3), the forward angles of deflection of the nozzle 51*a* and the nozzle 51*b* (angles through which the direction of flight of the ink droplets are deflected toward the downstream side in terms of the conveyance direction of the recording medium, from a vertical direction (a normal direction with respect to the ink ejection surface, as indicated by the alternate long and short dash line in FIG. 9)) are set respectively to θa1 and θb1 (where θa1≠θb1), and the rearward angles of deflection of the nozzle 51*a* and the nozzle 51*b* (the angles through which the direction of flight of the ink droplets are deflected toward the upstream side in terms of the direction of conveyance of the recording medium, from the vertical direction) are set respectively to θa2 and θb2 (where θa2≠θb2). The directions of flight of the ink droplets ejected consecutively from the nozzle 51*a* is deflected on the basis of the forward angle of deflection θa1 and the rearward angle of deflection θa2, and hence the ink droplets land respectively at positions a1 and a2 on the recording medium 16.

More specifically, if an electric field is generated in the direction from electrode 2 toward electrode 3 in FIG. 9 (in other words, in the direction from the upstream side toward the downstream side in terms of the conveyance direction of the recording medium), then the direction of flight of an ink droplet containing charged particles having a positive electrical charge is deflected through an angle of θa1 toward the downstream side in terms of the conveyance direction of the recording medium (the rightward direction in FIG. 9), and the landing position of the ink droplet whose direction of flight has been deflected in this way becomes a position a1 which is displaced to the downstream side in terms of the conveyance direction of the recording medium from a position directly below the nozzle 51 (the landing position in a case where the direction of flight is not deflected). Furthermore, if an electric field is generated in a direction from electrode 3 toward electrode 2 (in other words, in a direction from the downstream side toward the upstream side in terms of the conveyance direction of the recording medium), then the direction of flight is deflected through an angle of θa2 toward the upstream side in terms of the conveyance direction of the recording medium (the leftward direction in FIG. 9), and the landing position of the ink droplet whose direction of flight has been deflected in this way becomes a position a2 which is displaced toward the upstream side in terms of the conveyance direction of the recording medium from a position directly below the nozzle 51.

The magnitudes of the angles of deflection θa1, θa2, θb1 and θb2 are governed by the intensity of the electric field generated between electrode 2 and electrode 3 (namely, the voltage applied between electrode 2 and electrode 3). Hence, if the electric field intensity is increased, then the absolute value of the angles of deflection θa1, θa2, θb1 and θb2 increases, whereas if the electric field intensity is decreased, then the absolute value of the angles of deflection θa1, θa2, θb1 and θb2 decreases. In other words, the direction and intensity of the electric fields generated between the electrode pairs 1 are determined in accordance with the angles of deflection θa1, θa2, θb1 and θb2 set for respective nozzles 51.

If the absolute value of the forward angle θa1 of deflection of nozzle 51*a* is the same as the absolute value of the rearward angle θb2 of deflection of the nozzle 51*b*, and if the absolute value of the rearward angle θa2 of deflection of the nozzle 51*a* is the same as the absolute value of the forward angle θb1 of deflection of the nozzle 51*b* (in other words, |θa1|=|θb2|, |θa2|=θb1|), then it is possible to simplify the electrode drive unit 90 (see FIG. 6) which controls the electric fields generated between the electrodes 2 and electrodes 3.

The distance of deflection ya in the scanning plane of the recording medium (the spatial scanning width not accounting for the movement of the recording medium 16) of the ink droplets ejected consecutively from the nozzle 51*a* is expressed by the following equation, (Formula 3), in terms of the deflection shift amount ka (the deflection shift amount in the sub-scanning direction) set for the nozzle 51*a*, and the minimum dot pitch Pt.

$$ya=ka\times Pt \quad \text{(Formula 3)}$$

Similarly, the directions of flight of the ink droplets ejected consecutively from the nozzle 51*b* is deflected on the basis of the forward angle θb1 of deflection and the rearward angle θb2 of deflection described above, and hence the ink droplets land respectively at positions b1 and b2 on the recording medium 16. The distance of deflection yb in the scanning plane of the recording medium of the ink droplets ejected consecutively from the same nozzle (i.e. nozzle 51*b*) is expressed by the following equation, (Formula 4), in terms of 30 the deflection shift amount kb set for the nozzle 51*b*, and the minimum dot pitch Pt.

$$yb=kb\times Pt \quad \text{(Formula 4)}$$

The values ka in (Formula 3) and kb in (Formula 4) are integers equal to or greater than 2.

Since the recording medium 16 moves by the minimum dot pitch Pt toward the downstream side in terms of the conveyance direction of the recording medium, between a preceding droplet ejection and the subsequent droplet ejection, then the dot pitches Pda and Pdb (see FIG. 10B) between the dots formed on the recording medium 16 satisfy the following equations (Formula 5) and (Formula 6).

$$Pda=(ka+1)\times Pt \quad \text{(Formula 5)}$$

$$Pdb=(kb+1)\times Pt \quad \text{(Formula 6)}$$

The deflection shift amounts ka and kb set for the nozzle 51*a* and the nozzle 51*b* may be the same value or they may be different values. The (Formula 5) and (Formula 6) described above indicate that the ink droplets ejected consecutively from the same nozzle have a distance therebetween (dot pitch) equivalent to k+1 (e.g., ka+1 or kb+1) dots, on the recording medium 16.

In this way, when droplets are ejected consecutively using the same nozzle, by shifting the distance between the landing positions of the consecutively ejected ink droplets, on the basis of the deflection shift amount k (for example, ka and kb in FIG. 9), while the directions of flight of the droplets are deflected alternately toward the upstream side and the downstream side in terms of the conveyance direction of the recording medium, then the ink droplets which are ejected in consecutive fashion from the same nozzle do not form dots that are mutually adjacent in the conveyance direction of the recording medium, and hence landing interface on the recording medium 16 can be prevented.

In the present embodiment, the two types of angles of deflection set for each nozzle 51 are set in such a manner that one angle is toward the upstream side in terms of the conveyance direction of the recording medium and the other angle is toward the downstream in terms of the conveyance direction of the recording medium; however, it is also possible to set both of the angles of deflection to be on the upstream side or the downstream side in terms of the conveyance direction of the recording medium.

In the present embodiment, the landing time of an ejected ink droplet is treated as being substantially the same as the ejection timing of that droplet. In actual practice, the ink droplets land on the recording medium 16 after a prescribed flight time, from the ejection timing; however, since the flight times of the respective ink droplets are virtually the same, and since these flight times are sufficiently short compared to the droplet ejection cycle Tf and the conveyance time per unit conveyance amount of the recording medium 16, then the droplet ejection time and the landing time can be handled as being substantially the same times.

Figure 10A:
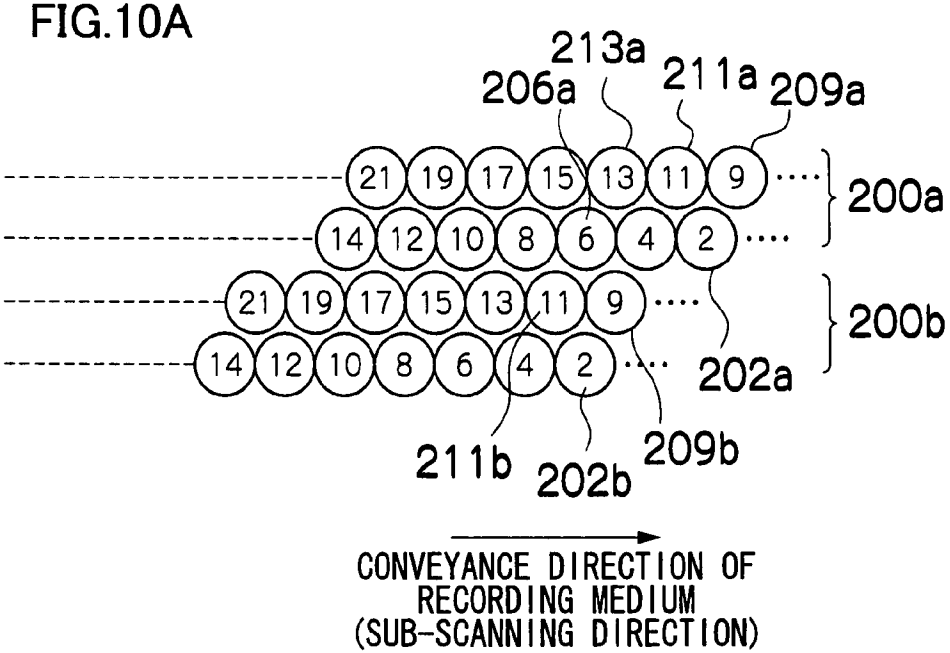
FIGS. 10A and 10B are diagrams showing droplet ejection control according to an embodiment of the present invention.
Figure 10B:
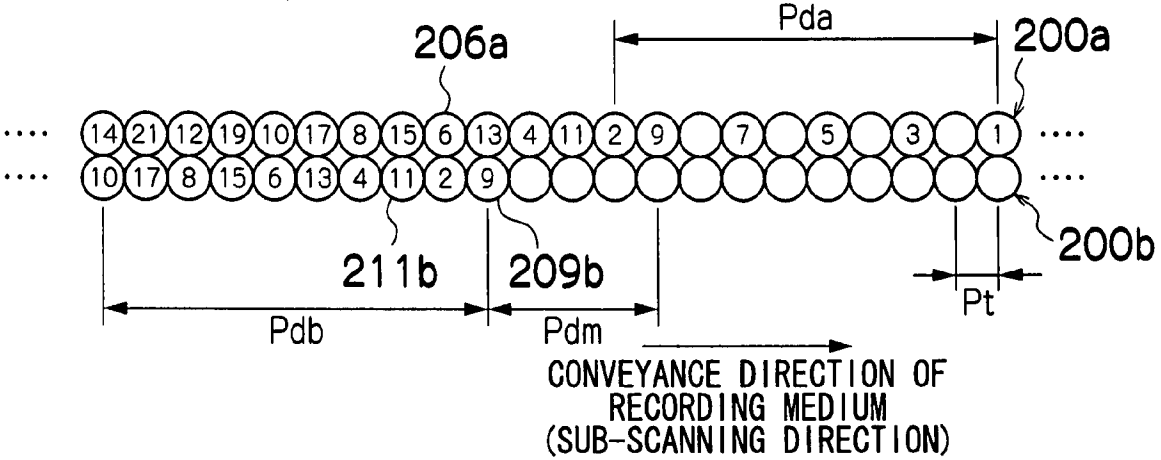

FIGS. 10A and 10B show one embodiment of dots formed on the recording medium 16 by means of the droplet ejection control described above.

In FIGS. 10A and 10B, the dot row 200*a* is constituted by dots formed by ink droplets ejected from the nozzle 51*a* shown in FIG. 3, and the dot row 200*b* is constituted by dots formed by ink droplets ejected from the nozzle 51*b* in FIG. 3.

The numbers indicated inside the dots shown in FIGS. 10A and 10B represent the relative ejection timing with reference to a particular ejection timing. For example, a dot marked with the number 2 is a dot formed by an ink droplet ejected at the droplet ejection timing in the second cycle of the droplet ejection cycle Tf, after the reference timing.

Furthermore, among the dots which constitute the actual dot rows 200*a* and 200*b*, the dots that are mutually adjacent in an alignment in one row in the substantially parallel direction with respect to the conveyance direction of the recording medium overlap with each other; however, in FIG. 10A, in order to make the illustration easier to appreciate, the adjacent dots in each dot row are depicted in shifted positions in the up/down direction in FIG. 10A. The upper level in FIG. 10A shows dots formed by ink droplets ejected at droplet ejection timings of an odd-numbered cycle, and the lower level shows dots formed by ink droplets ejected at droplet ejection timings of an even-numbered cycle.

For example, the dot 202*a* formed by an ink droplet ejected at the droplet ejection timing of the second cycle of the droplet ejection cycle Tf, from a reference timing, (the right-hand dot in the second row from the top), is positioned between the dot 209*a* formed by an ink droplet ejected at droplet ejection timing 9 (the right-hand dot in the uppermost row), and the dot 211*a* formed by an ink droplet ejected at droplet ejection timing 11 (the second dot from the right in the uppermost row). Similarly, among the dots constituting the dot row 200*b*, the dot 202*b* is positioned between the dot 209*b* and the dot 211*b*.

Furthermore, in FIG. 10B, the adjacency relationships of the dots are maintained, and adjacent dots which overlap with each other in practice are depicted as in a non-overlapping fashion. The values of Pda and Pdb shown in FIG. 10B indicate the dot pitch in a direction substantially parallel to the conveyance direction of the recording medium, between dots formed by ink droplets ejected consecutively from the same nozzle, as indicated by (Formula 5) and (Formula 6). Pt represents the minimum dot pitch in a direction substantially parallel to the conveyance direction of the recording medium.

FIGS. 10A and 10B show two rows of dots; however, by repeatedly forming these two dot rows across a prescribed image formation width, it is possible to form a desired image over the whole image formation width of the recording medium 16.

Next, the droplet landing time differential between ink droplets forming dots that are mutually adjacent in a direction substantially parallel to the conveyance direction of the recording medium, in the droplet ejection control according to the present embodiment, is described below. As shown in FIG. 10A, in the dot row 200*a* formed by ink droplets ejected from the nozzle 51*a*, the dots which are mutually adjacent in the direction substantially parallel to the conveyance direction of the recording medium (for example, dot 209*a* and dot 202*a*) are formed by ink droplets which are ejected from nozzle 51*a* at prescribed droplet ejection times between which a prescribed droplet landing time differential (droplet ejection interval) Ts is provided. The droplet landing time differential Ts between the ink droplets forming these adjacent dots is expressed by the following equation, (Formula 7), in terms of the deflection shift amount k and the droplet ejection cycle Tf.

$$Ts=Tf\times(k-1) \quad \text{(Formula 7)}$$

By setting the deflection shift amount k in such a manner that the droplet landing timing differential (droplet landing interval) Ts shown in (Formula 7) above is greater than the partial fixing time (quasi fixing time) To, it is possible to avoid: landing interference between ink droplets ejected consecutively from the same nozzle. In other words, if the relationship between the droplet landing time differential Ts between ink droplets ejected consecutively from the same nozzle, and the partial fixing time To of the ink, satisfies the following expression, (Formula 8), then landing interference between the ink droplets ejected consecutively from the same nozzle is avoided.

$$Ts \geqq To \quad \text{(Formula 8)}$$

The deflection shift amount k is expressed by the following relationship, (Formula 9), in terms of the droplet landing time differential Ts between the ink droplets ejected consecutively from the same nozzle, and the partial fixing time of the ink in question, To, on the basis of (Formula 7) and (Formula 8) above.

$$k \geqq (To/Tf)+1 \quad \text{(Formula 9)}$$

The partial fixing time (quasi fixing time) To is the period from the time at which an ink droplet lands on the recording medium 16 until the time at which it assumes a partially fixed state (quasi fixed state). Furthermore, the partially fixed state of an ink droplet referred to here indicates a state in which a previously ejected ink droplet has become fixed on the recording medium 16 to a degree whereby, even if a subsequently ejected ink droplet makes contact with the previously ejected ink droplet, landing interference of a kind that affects the quality of the recorded image dose not occur.

In other words, in the droplet ejection control described in the present embodiment, the occurrence of landing interference is permissible provided that this landing interference of a level which does not produce discernable bleeding or banding in the recorded image, and ink ejection is performed so as to prioritize high-speed printing. Higher image printing speeds can be achieved by ejecting an ink droplet so as to make contact with a previously ejected ink droplet on the recording medium 16, without waiting for the previously ejected ink droplet to become completely fixed.

FIG. 10A shows an embodiment where k=8. In other words, the deflection distance ya in the scanning plane of the recording medium (the spatial scanning width not accounting for movement of the recording medium 16) satisfies "ya=8×Pt". However, since the recording medium 16 is conveyed through a distance of one pitch (Pt) during the time period that the flight angle of deflection changes from θa1 to θa2, then the scanning distance ya' between the dots on the recording medium 16 satisfies "ya'=(8−1)×Pt". Consequently, the droplet landing time differential Ts between the formation of dots which are mutually adjacent on the recording medium 16 satisfies "Ts=Tf×(8−1)", on the basis of (Formula 7) stated above.

Figure 11A:
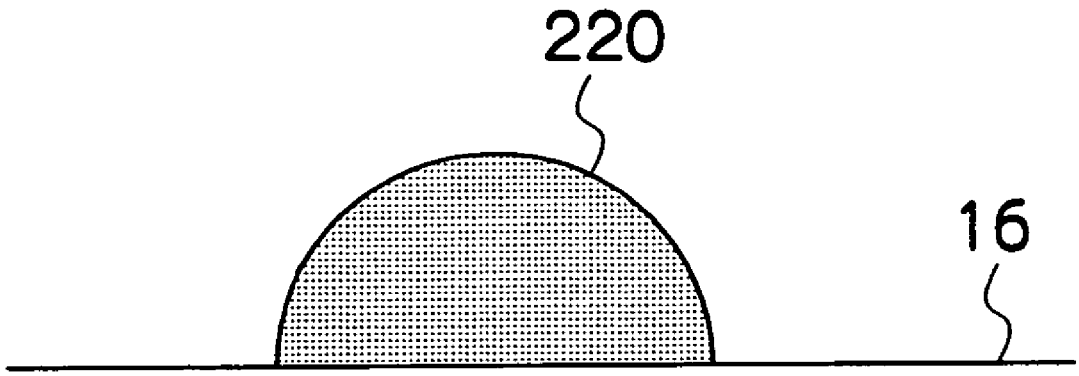
FIGS. 11A and 11B are diagrams illustrating a quasi fixed state (partially fixed state)
Figure 11B:
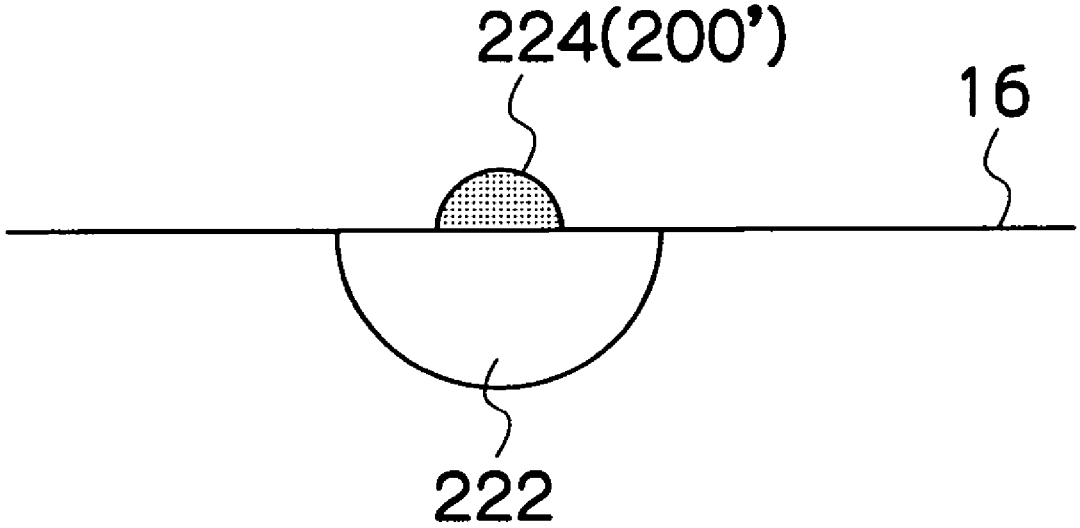

FIGS. 11A and 11B show one embodiment of a partially fixed state (quasi fixed state) of an ink droplet. FIG. 11A shows an ink droplet 220 immediately after landing on the recording medium 16. In a case where the ink fixes by permeating into the medium, then when the amount of permeation V2 (p1) of an ink droplet 220 into the recording medium 16 immediately after landing reaches a state which satisfies the following equation, (Formula 10), with respect to the volume V1 (p1) of the ink droplet 220 on the recording medium 16 immediately after landing, it can be considered that image quality is virtually unaffected, even though landing interference is not eliminated completely.

$$V2=V1\times 0.7 \qquad \text{(Formula 10)}$$

In other words, when the volume V2 of the ink 222 that has permeated into the recording medium 16 shown in FIG. 11B has become approximately 70% or more than 70% of the volume V1 of the ink droplet 220 immediately after landing as shown in FIG. 11A (V2≧V1×0.7), (in other words, when the volume V3 of the ink droplet 200' remaining on the recording medium 16 as shown in FIG. 11B has become approximately 30% or less than 30% of the volume V1 of the ink droplet 220 upon landing), then even if an ink droplet lands to form a dot which overlaps with the dot formed by the ink droplet 220, landing interference does not occur between that ink droplet and the previously deposited ink droplet 224 (an ink droplet having a volume V2 equivalent 30% of the volume V1 upon landing). In other words, the shape of the dot formed by the ink 222 that has permeated into the recording medium 16 is maintained.

In other words, when the partial fixing time period (partial permeation time period (quasi permeation time period)) To has elapsed after landing of an ink droplet 220 having a volume of V1 immediately after landing, the ink of volume V2 corresponding to 70% of the ink droplet 220 have permeated into the recording medium 16. A state where all of the volume V1 of the ink droplet 220 immediately after landing on the recording medium 16 has permeated into the recording medium 16 is called a completely fixed (permeated) state, and the time period from a landing time of ink deposited onto the recording medium 16 until a time at which the ink reaches a completely permeated state is called the complete fixing (permeation) time.

Furthermore, in a case where an ultraviolet-curable ink, or the like, which is fixed by being cured, is used, if the viscosity of a previously ejected ink droplet has become greater than a prescribed value, then an ink droplet is ejected to form a dot that is adjacent to the dot formed by the previously ejected ink droplet.

A droplet of ultraviolet-curable ink immediately after landing on the recording medium 16, has a viscosity of approximately 20 (mPa·s) or less. By applying a curing energy, such as ultraviolet light, immediately after landing of the droplet, the curing reaction is promoted chiefly on the surface of the ejection receiving medium 16, and the viscosity of the ink droplet is raised. In a state where the viscosity of the ink droplet has become approximately 1000 (mPa·s) or above, then it can be considered that the quality of the recorded image is virtually unaffected, even though landing interference is not eliminated completely.

In other words, a state where the viscosity of the ink on the recording medium 16 is equal to or greater than 1000 (mPa·s) is called a partially fixed state (quasi fixed state), and the time period from the time at which the ink droplet lands on the recording medium 16 (the time at which curing energy is applied), until the time at which the ink viscosity becomes equal to or greater than 1000 (mPa·s), is defined as a partial curing time (quasi curing time (partial fixing time (quasi fixing time)) To. A state where the ink viscosity is equal to or greater than 1000 (mPa·s) is, for instance, a state where the ink droplet has cured to a level at which it does not move from its prescribed landing position.

The partial fixing time To varies depending on the type of ink, the type of recording medium 16, the dot diameter, and the like. Therefore, a desirable mode is one in which partial fixing times To are previously stored in the form of a data table in relation to parameters such as the ink type, type of recording medium 16, and dot diameter, in a storage medium (a memory such as the image member 74 shown in FIG. 6 or the image buffer memory 82, or the like), in such a manner that a value of a partial fixing time To can be read out in accordance with the operating conditions.

Next, the droplet landing time differential between ink droplets forming dots that are mutually adjacent in a direction substantially perpendicular to the conveyance direction of the recording medium is described below. In the droplet ejection timing control described in the present embodiment, in the case of ink droplets ejected at substantially the same timing from nozzles which eject ink droplets to form dots that are mutually adjacent in a direction substantially perpendicular to the conveyance direction of the recording medium, the directions of flight of the ink droplets are deflected respectively in such a manner that the ink droplets are separated by a prescribed distance in the direction substantially parallel to the conveyance direction of the recording medium (namely, that they have a prescribed phase differential) when they land on the recording medium.

As shown in FIG. 10A, the dot 213*a* in the dot row 200*a* which is formed by an ink droplet ejected from nozzle 51*a*, and the dot 209*b* in the dot row 200*b* which is formed by an ink droplet ejected from nozzle 51*b* are dots that are mutually adjacent in the direction substantially perpendicular to the conveyance direction of the recording medium, and there is a droplet landing time differential of four cycles of the droplet ejection timing cycle Tf, between the dot 213*a* formed by an ink droplet ejected in the $13^{th}$ cycle of the droplet ejection cycle Tf from the reference timing, and the dot 209*b* formed by an ink droplet ejected in the $9^{th}$ cycle of the droplet ejection cycle Tf from the reference timing. Similarly, the ink droplets forming the dot 206*a* and the dot 202*b* which are mutually adjacent in the direction substantially perpendicular to the recording medium conveyance direction have a droplet landing time differential of four cycles of the droplet ejection cycle Tf.

In other words, dots formed by ink droplets landing on the medium at substantially the same timing (for example, dot 202*a* and dot 202*b*), from nozzles which eject ink droplets to form dots that are mutually adjacent in the direction substantially perpendicular to the conveyance direction of the recording medium, have a distance equivalent to 4 dots between them, in the direction substantially parallel to the conveyance direction of the recording medium (namely, a deflection distance L which is equivalent to the time of four cycles of the droplet ejection cycle Tf).

In other words, provided that the droplet landing time differential Tsm corresponding to the dot pitch Pdm in the direction substantially parallel to the conveyance direction of the recording medium shown in FIG. 10B (where Tsm=Pdm/V (the conveyance speed of the recording medium 16)), is equal to or greater than the partial fixing time To of the ink droplets (in other words, if Tsm≧To), then it is possible to prevent landing interference between ink droplets forming dots that are mutually adjacent in the direction substantially perpendicular to the conveyance direction of the recording medium.

In the present embodiment, the deflection distance L between an ink droplet ejected from the nozzle 51*a*, and an ink droplet ejected from the nozzle 51*b* (see FIG. 9) at substantially the same droplet landing timing (substantially simultaneously), is defined by multiplying the minimum dot pitch Pt in the conveyance direction of the recording medium by the amount S of shift in the droplet ejection position (i.e., droplet ejection position shift amount S).

Next, the droplet landing time differential between ink droplets forming dots that are mutually adjacent in an oblique direction is described below. In the droplet ejection control according to the present embodiment, in order to arrange the dots at high density, the dots are formed in such a manner that dots which are mutually adjacent in an oblique direction overlap with each other, as shown in FIG. 8.

As shown in FIG. 10B, the dot 206*a* is adjacent in the oblique direction to the dot 209*b* and the dot 211*b*; the droplet landing time differential between the ink droplet that forms dot 206*a* and the ink droplet that forms dot 209*b* corresponds to 3 cycles of the droplet ejection cycle Tf, and the droplet landing time differential between the ink droplet that forms the dot 206*a* and the ink droplet that forms the dot 211*b* corresponds to 5 cycles of the droplet ejection cycle Tf. In this way, in the droplet ejection control according to the present embodiment, it is possible to provide a droplet landing time differential between the ink droplets which form dots that are mutually adjacent in an oblique direction, and by setting angles of deflection of ink droplets ejected from the nozzles in such a manner that this droplet landing time differential is equal to or greater than the partial fixing time To of the ink droplets, then it is possible to prevent landing interference between ink droplets which form dots that are mutually adjacent in the oblique direction.

In other words, in the droplet ejection control according to the present embodiment, directions of flight of ink droplets ejected from the nozzles are deflected in a direction substantially parallel to the conveyance direction of the recording medium, and the deflection shift amount k and the shift amount (droplet ejection position shift amount) S, which is the distance between dots formed by ink droplets landing at substantially the same droplet landing timing in a row of dots that are mutually adjacent in a direction substantially perpendicular to the conveyance direction of the recording medium, are set in such a manner that the droplet landing time differential Ts between ink droplets forming adjacent dots is equal to or greater than the partial fixing time To of the ink droplets. Thereby, landing interference is prevented between ink droplets which form dots that are adjacent in either a direction substantially perpendicular to the conveyance direction of the recording medium, a direction substantially parallel to the conveyance direction of the recording medium, or an oblique direction with respect to the conveyance direction of the recording medium, and hence dots arranged at high density on the recording medium 16 can be formed at high speed.

Figure 12:
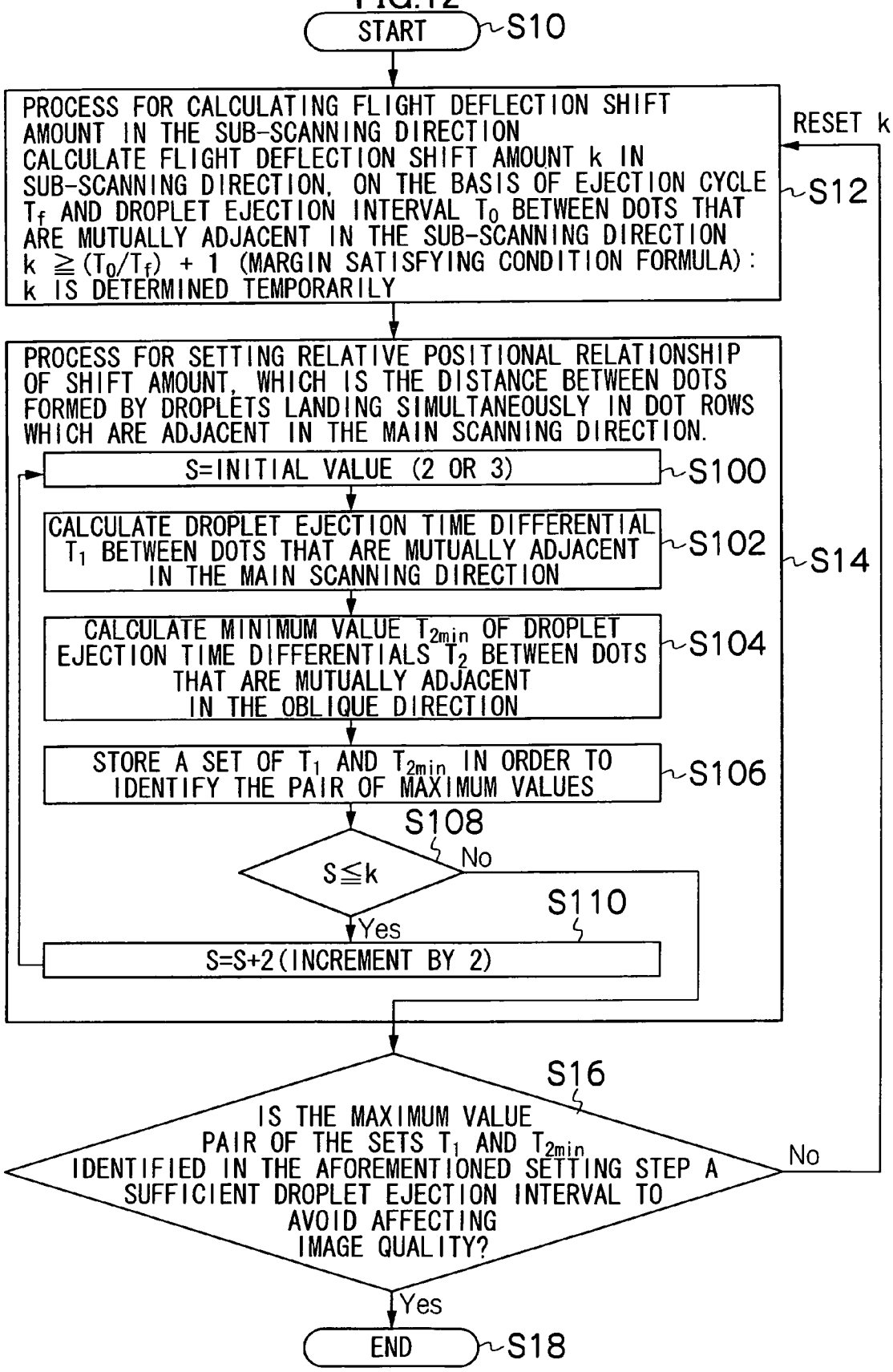
FIG. 12 is a flowchart showing a control sequence for setting the amount of deflection of the direction of flight in the droplet ejection control according to an embodiment of the present invention.

FIG. 12 shows a flowchart of control for setting the deflection shift amount k and the droplet ejection position shift amount S, in the droplet ejection control described above. When control starts (step S10), a step for calculating the deflection shift amount k in a direction substantially parallel to the conveyance direction of the recording medium (sub-scanning direction), (in other words, flight change shift amount k in the sub-scanning direction) is performed (step S12).

In step S12, the deflection shift amount k is determined on the basis of the conditions of the droplet ejection cycle (ejection cycle) Tf and the droplet landing time differential Ts of the ink droplets which form dots that are mutually adjacent in the sub-scanning direction. The resulting value of k is stored temporarily in a prescribed memory.

This deflection shift amount k preferably satisfies the conditions indicated in (Formula 9) above, and is preferably determined so as to have a prescribed margin. In step S12, when the deflection shift amount k is temporarily determined, the procedure advances to step S14.

At step S14, the shift amount (droplet ejection position shift amount S) is set, which is the distance between dots formed by ink droplets landing at substantially the same droplet landing timing, in dot rows that are mutually adjacent in the direction substantially perpendicular to the conveyance direction of the recording medium. This shift amount indicates the relative positional relationship between dots that are mutually adjacent in the direction (main scanning direction) which is substantially perpendicular to the conveyance direction of the recording medium. In other words, at step S14, the optimal value for the phase differential (droplet landing time differential) in the sub-scanning direction between ink droplets forming dots that are mutually adjacent in the main scanning direction is determined.

At step S14, firstly, "S=2 (or S=3)" is set as an initial value for the droplet ejection position shift amount S (Step S100). The droplet landing time differential T1 between ink droplets which form dots that are mutually adjacent in the main scanning direction is determined on the basis of the initial value of the droplet ejection position shift amount S (step S102), and furthermore, the minimum value T2min of the droplet landing time differentials T2 between ink droplets which form dots that are mutually adjacent in the oblique direction is also found (step S104).

If the initial value of the droplet ejection position shift amount S is taken to be "S=1", then dots formed by ink droplets ejected at the same timing are mutually adjacent in an oblique direction. Therefore, a value of two or greater is set as the initial value of the droplet ejection position shift amount S.

The droplet landing time differential T1 between ink droplets which form dots that are mutually adjacent in the main scanning direction, as determined at step S102, and the minimum value T2min of the droplet landing time differentials T2 between the ink droplets which form dots that are mutually adjacent in the oblique direction as determined at step S104 are stored temporarily in a prescribed memory, as one set of information (step S106), and the procedure then advances to step S108.

The droplet landing time differential T1 between the ink droplets which form dots that are mutually adjacent in the main scanning direction and the minimum value T2min of the droplet landing time differentials T2 between the ink droplets which form dots that are mutually adjacent in the oblique direction have the following relationships: if the droplet landing time differential T1 between the ink droplets which form dots that are mutually adjacent in the main scanning direction is increased, then the minimum value T2min of the droplet landing time differentials T2 between the ink droplets which form dots that are mutually adjacent in the oblique direction becomes smaller, whereas if the minimum value T2min of the droplet landing time differentials T2 between the ink droplets which form dots that are mutually adjacent in the oblique direction is increased, then the droplet landing time differential T1 between the ink droplets which form dots that are mutually adjacent in the main scanning direction becomes smaller.

In other words, the optimal value for the droplet ejection position shift amount S is required to be found by adjusting the droplet landing time differential T1 between the ink droplets which form dots that are mutually adjacent in the main scanning direction and the minimum value T2min of the droplet landing time differentials. T2 between the ink droplets which form dots that are mutually adjacent in the oblique direction, together, as a set.

At step S108, it is determined whether the droplet ejection position shift amount S is equal to or less than the deflection shift amount k or not. If the droplet ejection position shift amount S is equal to or less than the deflection shift amount k at step S108 (Yes verdict), then the droplet ejection position shift amount S is increased by a prescribed value (step S110), and the droplet landing time differential T1 between the ink droplets which form dots that are mutually adjacent in the main scanning direction and the minimum value T2min of the droplet landing time differentials T2 between the ink droplets which form dots that are mutually adjacent in the oblique direction, are determined again.

More specifically, at step S110, the droplet ejection position shift amount S is incremented by 2, whereupon the procedure advances to step S100 and the droplet landing time differential T1 and minimum value T2min of T2 described above are determined on the basis of this increased droplet ejection position shift amount S.

Figure 13A:
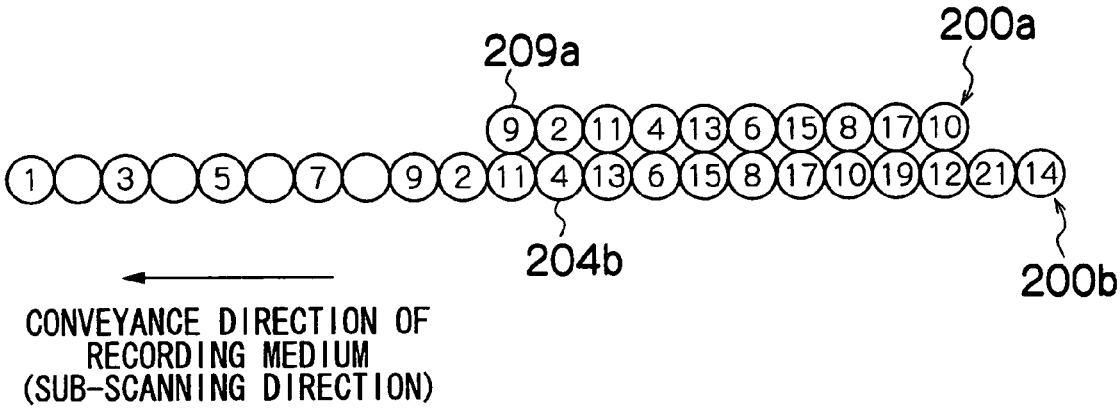
FIGS. 13A to 13C are diagrams showing control for setting the amount of deflection of the direction of flight as shown in FIG. 12.
Figure 13B:
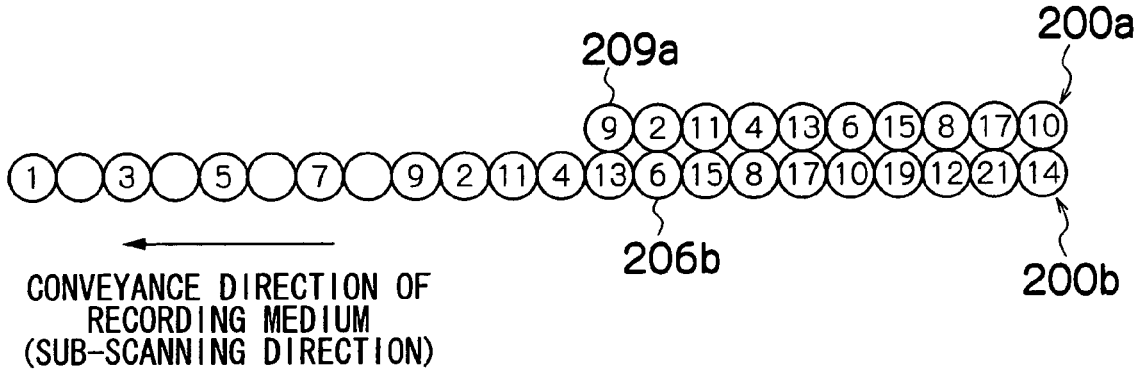
Figure 13C:
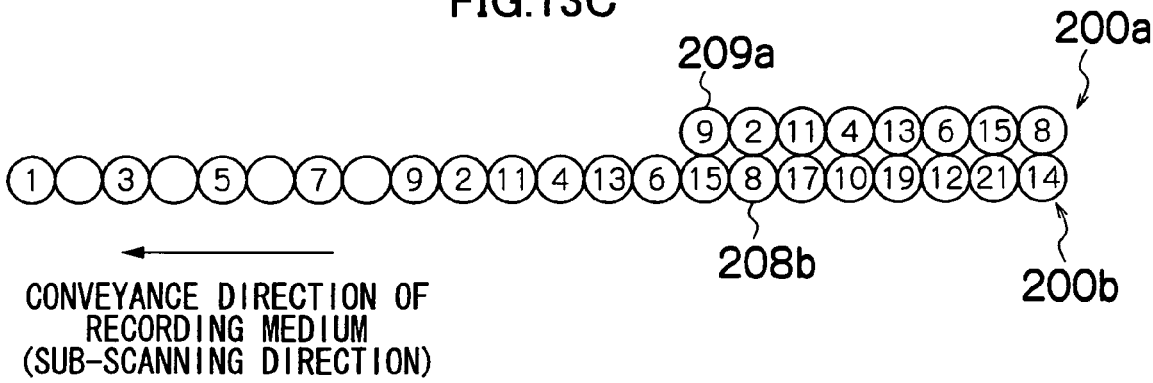

FIG. 13A shows a dot arrangement in a case where the deflection shift amount k satisfies "k=8" (initial value, the minimum value of the droplet landing time differential Ts between ink droplets which form mutually adjacent dots in the sub-scanning direction corresponds to a time period equivalent to 7 cycles of the droplet ejection cycle Tf), and where the droplet ejection position shift amount S satisfies "S=2" (initial value). FIG. 13B shows a dot arrangement where the deflection shift amount k satisfies "k=8" and the droplet ejection position shift amount S satisfies "S=4" (where the droplet ejection position shift amount S has been incremented by 2), and FIG. 13C shows a dot arrangement where "S=6" (where the droplet ejection position shift amount S has been incremented by 4) is satisfied.

In a case where the droplet ejection position shift amount S=2, 4, 6 . . . (an even number equal to or greater than 2), the droplet landing time differential T1 between ink droplets which form dots that are mutually adjacent in the main scanning direction is determined by the following equation, (Formula 11).

$$T1=S \quad \text{(Formula 11)}$$

Furthermore, the minimum value T2min of the droplet landing time differentials T2 between ink droplets which form dots that are mutually adjacent in the oblique direction is determined by the following equation, (Formula 12).

$$T2min=k-S-1 \quad \text{(Formula 12)}$$

As shown in FIG. 13A, if the droplet ejection position shift amount S satisfies "S=2", then the droplet landing time differential T1 between the ink droplets which form dots that are mutually adjacent in the main scanning direction corresponds to a time period equivalent to 2 cycles of the droplet ejection cycle Tf. In this case, the minimum value T2min of the droplet landing time differentials T2 between the ink droplets which form dots that are mutually adjacent in the oblique direction corresponds to a time period equivalent to 5 cycles of the droplet ejection cycle Tf. One embodiment of such a combination of dots is the dot 209*a* and the dot 204*b*.

Furthermore, as shown in FIG. 13B, if the droplet ejection position shift amount S satisfies "S=4", then the droplet landing time differential T1 between the ink droplets which form dots that are mutually adjacent in the main scanning direction corresponds to a time period equivalent to 4 cycles of the droplet ejection cycle Tf. In this case, the minimum value T2min of the droplet landing time differentials T2 between the ink droplets which form dots that are mutually adjacent in the oblique direction corresponds to a time period equivalent to 3 cycles of the droplet ejection cycle Tf. One embodiment of such a combination of dots is the dot 209*a* and the dot 206*b*.

If the droplet ejection position shift amount S is incremented further by 2 and hence the droplet ejection position shift amount S satisfies "S=6", as shown in FIG. 13C, then the droplet landing time differential T1 between the ink droplets which form dots that are mutually adjacent in the main scanning direction corresponds to a time period equivalent to 6 cycles of the droplet ejection cycle Tf. In this case, the minimum value T2min of the droplet landing time differentials T2 between the ink droplets which form dots that are mutually adjacent in the oblique direction corresponds to a time period equivalent to 1 cycle of the droplet ejection cycle Tf. One embodiment of such a combination of dots is the dot 209*a* and the dot 208*b*.

In the dot arrangement shown in FIG. 13C, the ink droplets forming dots that are mutually adjacent in the oblique direction are ejected at consecutive timings, and in the case of high-speed printing as described in the present embodiment, it is difficult to prevent landing interference between these ink droplets. Therefore, the settings of "deflection shift amount k=8" and "droplet ejection shift amount S=6" are not used, and other combinations of settings are used for the deflection shift amount k and the droplet ejection position shift amount S.

Figure 14A:
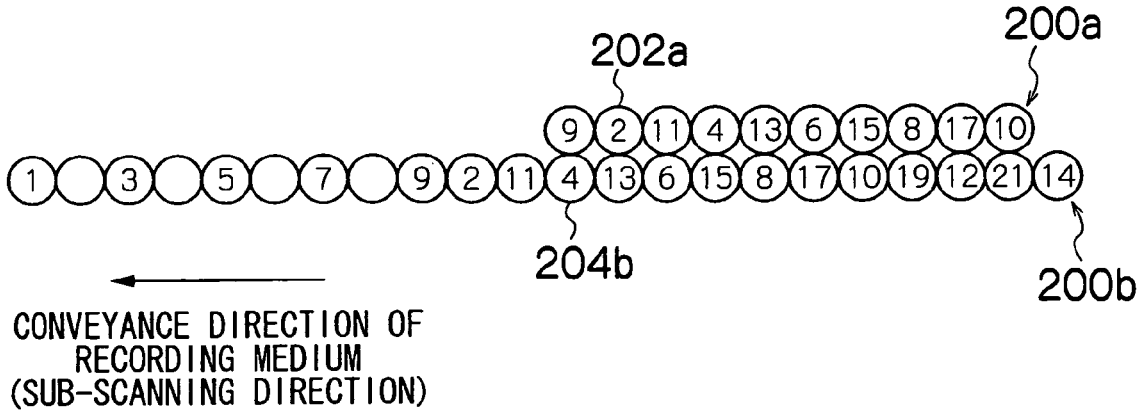
FIGS. 14A to 14C are diagrams showing control for setting the amount of deflection of the direction of flight as shown in FIG. 12.
Figure 14B:
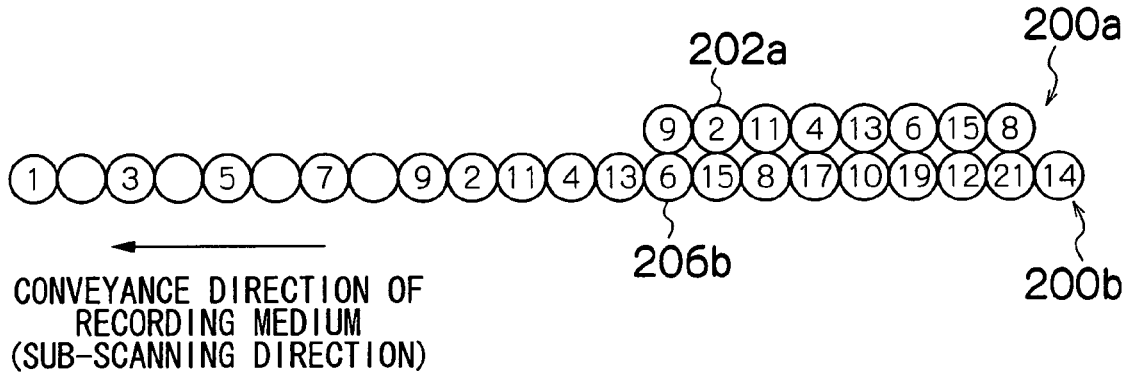
Figure 14C:
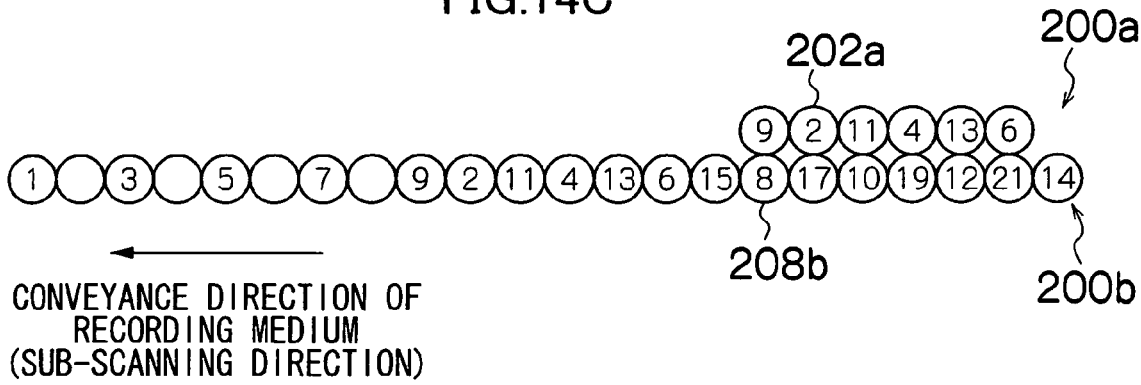

Furthermore, FIGS. 14A to 14C show dot arrangements in cases where the deflection shift amount k satisfies "k=8", and the droplet ejection position shift amount S satisfies "S=3, 5, 7, . . . (an odd number equal to or greater than 3)". In a case where the droplet ejection position shift amount S satisfies "S=3", the droplet landing time differential T1 between ink droplets which form dots that are mutually adjacent in the main scanning direction is determined by the following equation, (Formula 13).

$$T1=k-S \quad \text{(Formula 13)}$$

Furthermore, the minimum value T2min of the droplet landing time differentials T2 between ink droplets which form dots that are mutually adjacent in the oblique direction is determined by the following equation, (Formula 14).

$$T2min=S-1 \quad \text{(Formula 14)}$$

As shown in FIG. 14A, if the droplet ejection position shift amount S satisfies "S=3", then the droplet landing time differential T1 between the ink droplets which form dots that are mutually adjacent in the main scanning direction corresponds to a time period equivalent to 5 cycles of the droplet ejection cycle Tf. In this case, the minimum value T2min of the droplet landing time differentials T2 between the ink droplets which form dots that are mutually adjacent in the oblique direction corresponds to a time period equivalent to 2 cycles of the droplet ejection cycle Tf. One embodiment of such a combination of dots is the dot 202*a* and the dot 204*b*.

Furthermore, as shown in FIG. 14B, if the droplet ejection position shift amount S satisfies "S=5", then the droplet landing time differential T1 between the ink droplets which form dots that are mutually adjacent in the main scanning direction corresponds to a time period equivalent to 3 cycles of the droplet ejection cycle Tf. In this case, the minimum value T2min of the droplet landing time differentials T2 between the ink droplets which form dots that are mutually adjacent in the oblique direction corresponds to a time period equivalent to 4 cycles of the droplet ejection cycle Tf. One embodiment of such a combination of dots is the dot 209*a* and the dot 206*b*.

If the droplet ejection position shift amount S is incremented further by 2 and hence the droplet ejection position shift amount S satisfies "S=7", as shown in FIG. 14C, then the droplet landing time differential T1 between the ink droplets which form dots that are mutually adjacent in the main scanning direction corresponds to a time period equivalent to 2 cycles of the droplet ejection cycle Tf. In this case, the minimum value T2min of the droplet landing time differentials T2 between the ink droplets which form dots that are mutually adjacent in the oblique direction corresponds to a time period equivalent to 6 cycles of the droplet ejection cycle Tf. One embodiment of such a combination of dots is the dot 202*a* and the dot 208*b*.

In this way, the droplet landing time differential T1 between the ink droplets which form dots that are mutually adjacent in the main scanning direction, and the minimum value T2min of the droplet landing time differentials T2 between the ink droplets which form dots that are mutually adjacent in the oblique direction, are determined in the form of sets, while the droplet ejection position shift amount S is altered from 2 to 7, and the combination of the differential shift amount k and the droplet ejection position shift amount S is determined in such a manner that these values are both greater than the partial fixing time To of the ink.

In the present embodiment, if the droplet ejection position shift amount S is changed (increased or decreased) by 2 at a time, then the same formulas can be used for calculating the droplet landing time differential T1 between the ink droplets which form dots that are mutually adjacent in the main scanning direction and the minimum value T2min of the droplet landing time differentials T2 between the ink droplets which form dots that are mutually adjacent in the oblique direction, and hence the droplet ejection position shift amount S is changed by 2 at a time, at step S110 in FIG. 12. Of course, it is also possible to change the droplet ejection position shift amount S by 1 at a time, at step S110 in FIG. 12. In a mode where the droplet ejection position shift amount S is changed by 1 at a time, the deflection shift amount k is determined by alternately using (Formula 11) and (Formula 13), and the droplet ejection position shift amount S is determined by alternately using (Formula 12) and (Formula 14).

At step S108, if the droplet ejection position shift amount S is equal to or greater than the deflection shift amount k (if S≧9) (No verdict), then the procedure advances to step S16, and it is determined whether the values stored at step S106 for the droplet landing time differential T1 between the ink droplets which form dots that are mutually adjacent in the main scanning direction and the minimum value T2min of the droplet landing time differentials T2 between the ink droplets which form dots that are mutually adjacent in the oblique direction, are greater than the partial fixing time To or not. If the values of the droplet landing time differential T1 between the ink droplets which form dots that are mutually adjacent in the main scanning direction and the minimum value T2min of the droplet landing time differentials T2 between the ink droplets which form dots that are mutually adjacent in the oblique direction stored at step S106 are greater than the partial fixing time To, in other words, if it is determined that the droplet landing time differential T1, and the minimum value T2min of T2 are droplet landing time differential of a level that does not substantially affect image quality (Yes verdict), then the deflection shift amount k and the droplet ejection position shift amount S are established, as a set, and the control for setting the deflection shift amount k and the droplet ejection position shift amount S terminates (step S18).

If, on the other hand, the minimum value T1min of the droplet landing time differentials and T2min are smaller than the partial fixing time To, in other words, if it is determined that the minimum value T1min of the droplet landing time differential and T2min are droplet landing time differentials of a level which affects image quality (No verdict), then the procedure returns to step S12 and the deflection shift amount k is set again.

In this way, the deflection shift amounts k and the droplet ejection position shift amounts S are set in such a manner that the droplet landing time differentials between ink droplets which form dots that are mutually adjacent in the main scanning direction, the sub-scanning direction and the oblique direction, are equal to or greater than the partial fixing time To, and the ejection of ink droplets is controlled on the basis of the deflection shift amounts k and droplet ejection position shift amounts S which are set in such a way.

Application Embodiment

Figure 15:
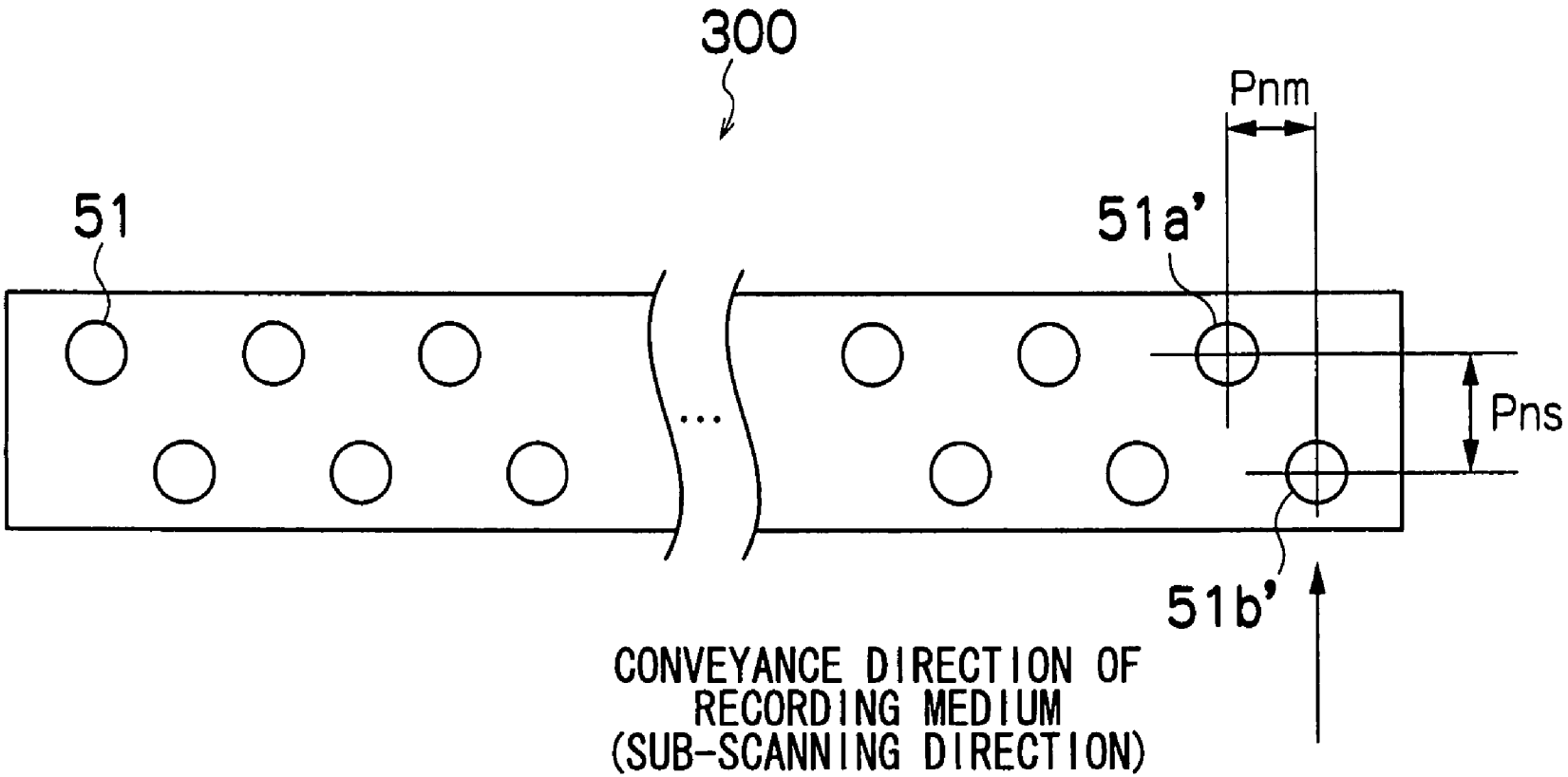
FIG. 15 is a plan diagram showing an approximate structure of a print head according to an application of an embodiment of the present embodiment.

Next, an application of the present embodiment is described below. FIG. 15 is a schematic drawing showing a nozzle arrangement in a print head 300 relating to an application embodiment. FIG. 15 shows a view in which a portion of the structure shown in FIG. 3 (for example, the electrode pairs 1, and the pressure chambers 52) is omitted.

As shown in FIG. 15, the head 300 has a nozzle arrangement structure in which the nozzles 51 are arranged in a staggered matrix configuration; the pitch in the direction substantially perpendicular to the conveyance direction of the recording medium between nozzles which eject ink droplets to form dots that are mutually adjacent in the direction substantially perpendicular to the conveyance direction of the recording medium (for example, the pitch between nozzle 51*a*' and nozzle 51*b*' as shown in FIG. 15) is Pnm, and the pitch in the direction substantially parallel to the conveyance direction of the recording medium between nozzles which are mutually adjacent in the direction substantially parallel to the conveyance direction of the recording medium (for example, between nozzle 51*a*' and nozzle 51*b*' as shown in FIG. 15) is Pns.

According to the head 300 having two nozzle rows of nozzles 51 arranged in a staggered matrix configuration in this way, the effective nozzle density in the direction substantially perpendicular to the conveyance direction of the recording medium can be increased, in comparison with a head 50 having one nozzle row as shown in FIG. 3, and hence improved image quality can be achieved in the recorded image.

Figure 16:
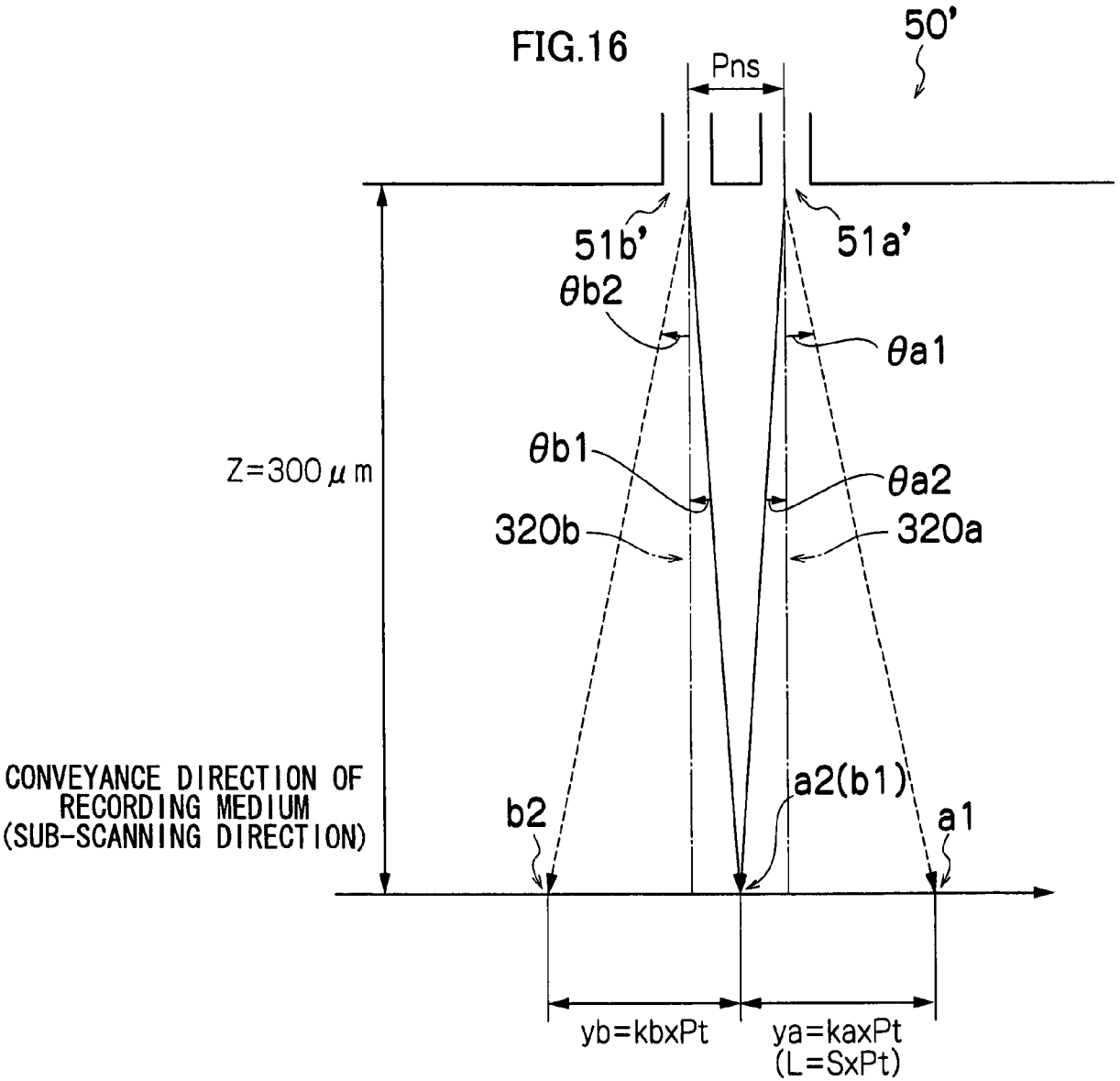
FIG. 16 is a diagram showing the deflection of the direction of flight of the ink droplets ejected from the print head shown in FIG. 15.

Next, the droplet ejection control performed in the print head 300 having nozzles 51 arranged in a staggered matrix configuration as shown in FIG. 15 is described below with reference to FIG. 16 and FIG. 17. As shown in FIG. 16, ink droplets ejected from the nozzle 51*a*' are deflected through a forward angle θa1 of deflection or a rearward angle θa2 of deflection with respect to the normal direction 320*a* from the ejection surface of the nozzle 51*a*', as indicated by an alternate long and short dash line. Consequently the ink droplets from the nozzle 51*a*' land at positions a1 and a2 on the recording medium 16 respectively. Furthermore, the ink droplets ejected from nozzle 51*b*' are deflected through a forward angle θb1 of deflection and a rearward angle θb2 of deflection with respect to the normal direction 320*b* from the ejection surface of the nozzle 51*b*', as indicated by an alternate long and short dash line. Consequently the ink droplets from the nozzle 51*b*' land at positions b1 and b2 on the recording medium 16 respectively. With respect to the aforementioned angles of deflection θa1, θa2, θb1 and θb2, the downstream side in terms of the conveyance direction of the recording medium is considered as the forward direction, and the upstream side is considered as the rearward direction, with respect to the normal directions 320*a* and 320*b* (vertical directions) from the surface on which the nozzle 51*a*' and the nozzle 51*b*' are formed.

The directions of flight of the ink droplets ejected at droplet ejection timings at odd-numbered cycles of the droplet ejection cycle Tf, from a particular reference timing, are deflected through the forward angle of deflection θa1 or θb1 (or the rearward angle of deflection θa2 or θb2). The directions of flight of the ink droplets ejected at droplet ejection timings at even-numbered cycles of the droplet ejection cycle Tf, from the reference timing, are deflected through the rearward angle of deflection θa2 or θb2 (or the forward angle of deflection θa1 or θb1).

In the present embodiment, angles of deflection of the nozzle 51*a*' and the nozzle 51*b*' are set in such a manner that the landing position a2 of an ink droplet ejected from the nozzle 51*a*' and deflected on the basis of the rearward angle θa2 of deflection, and the landing position b1 of an ink droplet ejected from the nozzle 51*b*' and deflected on the basis of the forward angle θb1 of deflection, are substantially the same position.

In other words, in the droplet ejection control according to the present application embodiment, the deflection distance ya with respect to the nozzle 51*a*' in the scanning plane (ya=ka×Pt), is substantially the same as the deflection distance L (L=S×Pt) between ink droplets ejected at the same timing from nozzles (e.g., nozzle 51*a*' and nozzle 51*b*' in FIG. 16) which eject droplets to form dots that are adjacent to each other in a direction substantially perpendicular to the conveyance direction of the recording medium.

In other words, between the dot row 200*a*' (see FIG. 17) formed by ink droplets ejected from the nozzle 51*a*' and the dot row 200*b*' (see FIG. 17) formed by ink droplets ejected from the nozzle 51*b*', there is a phase differential equivalent to the deflection distance ya (ya=L) in the scanning plane, in the direction substantially parallel to the conveyance direction of the recording medium.

Of course, it is also possible to set the rearward angle θa2 of deflection of the nozzle 51*a*' and the forward angle θb1 of deflection of the nozzle 51*b*' in such a manner that the landing position a2 of an ink droplet from the nozzle 51*a*' deflected on the basis of the rearward angle θa2 of deflection and the landing position b1 of an ink droplet from nozzle 51*b*' deflected on the basis of the forward angle θb1 of deflection,. are different positions.

Figure 17:
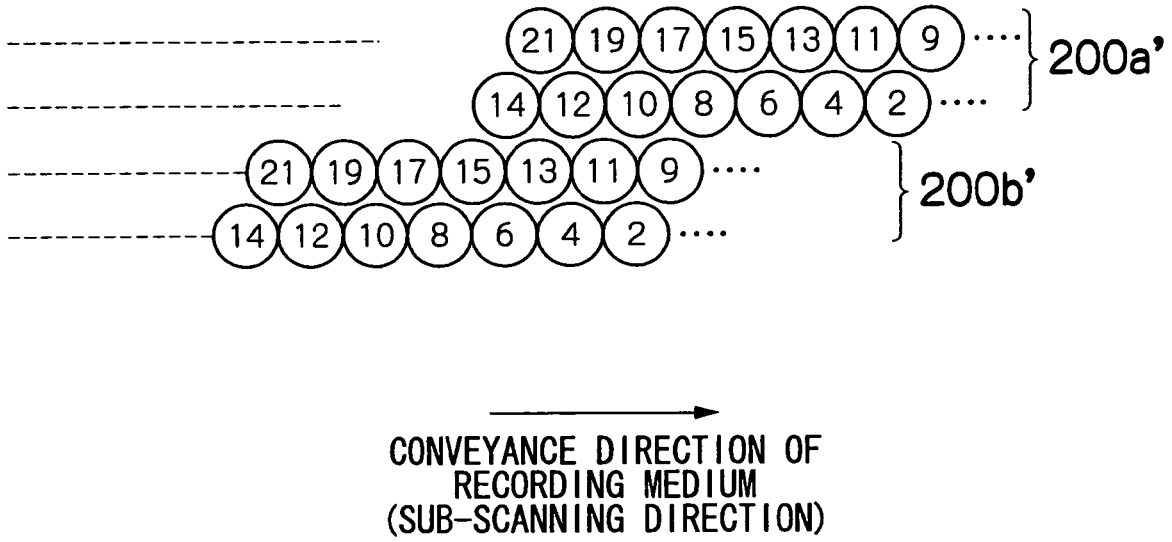
FIG. 17 is a diagram showing droplet ejection control according to an application of an embodiment of the present invention.

FIG. 17 shows a dot arrangement according to the droplet ejection control shown in FIG. 16. Similarly to FIG. 10A, the dot row 200*a*' and the dot row 200*b*' shown in FIG. 17 are depicted in such a manner that the dots formed by ink droplets ejected at odd-numbered cycles with respect to a particular reference timing are depicted in the upper level, and the dots formed by ink droplets ejected at even-numbered cycles are depicted in the lower level.

In the dot arrangement shown in FIG. 17, the droplet landing time differential T1 between the ink droplets which form dots that are mutually adjacent in the sub-scanning direction corresponds to a time period equivalent to 7 cycles of the droplet ejection cycle Tf (in other words, the deflection shift amount k=8), and the minimum value T2min of the droplet landing time differentials T2 between the ink droplets which form dots that are mutually adjacent in the main scanning direction corresponds to a time period equivalent to 8 cycles of the droplet ejection cycle Tf (in other words, the droplet ejection position shift amount S=8). By adopting droplet ejection control which achieves the dot arrangement shown in FIG. 17, each set of the ink droplets which forms dots that are mutually adjacent in a direction substantially parallel to the conveyance direction of the recording medium, a direction substantially perpendicular to the conveyance direction of the recording medium, and an oblique direction with respect to the conveyance direction of the recording medium, has a prescribed droplet landing time differential Ts, and a deflection shift amount k and a droplet ejection position shift amount S are set in such a manner that the droplet landing time differential Ts is equal to or greater than the partial fixing time To of the ink droplets.

Droplet Ejection Conditions

One embodiment of the droplet ejection conditions according to the present embodiment is described below. If the resolution of the recorded image (dot density) is 600 dpi (dots per inch), then the minimum dot pitch Pt is substantially 42.2 (μm). If the conveyance speed of the recording medium 16 in this case is taken to be 1.67 (mm/sec), then the droplet ejection cycle Tf is approximately 25.3 (msec).

If a partial fixing time of 20 (msec), which applies to a combination of a general ink and recording medium 16, can be used as the partial fixing (permeation) time of the medium (recording medium 16) used, then it is possible to print without landing interference, while the aforementioned conveyance speed of 1.67 (mm/sec) is maintained, without applying the droplet ejection control according to an embodiment of the present invention.

If the conveyance speed is set to be approximately 10 (mm/sec) (approximately 6 times the speed in the aforementioned embodiment), in order to increase productivity, then the droplet ejection cycle Tf becomes approximately 4.2

(msec), and if the droplet ejection control according to an embodiment of the present invention is not applied, then landing interference occurs and there is a possibility that the quality of the recorded image is degraded.

If droplet ejection control according to an embodiment of the present invention is applied under print conditions of this kind, then by setting the deflection shift amount k and the droplet ejection position shift amount S in such a manner that the droplet landing time differentials between ink droplets which form dots that are mutually adjacent in the main scanning direction, the sub-scanning direction, and the oblique direction, become equal to or greater than 5 cycles of the droplet ejection cycle Tf, then it is possible to form a recorded image of high quality, while landing interference is avoided even in the case of high-speed printing.

Furthermore, if the resolution of the recorded image is 1200 dpi, then the minimum dot pitch Pt becomes approximately 21.1 μm. If the conveyance speed of the recording medium 16 is 1.67 (mm/sec), then the droplet ejection cycle Tf is approximately 12.6 (msec), and if a standard ink and recording medium 16 are used as described above, then landing interference may occur and there is a possibility that the quality of the recorded image is degraded.

If droplet ejection control according to an embodiment of the present invention is applied under print conditions of this kind, then by setting the deflection shift amount k and the droplet ejection position shift amount S in such a manner that the droplet landing time differentials between ink droplets which form dots that are mutually adjacent in the main scanning direction, the sub-scanning direction, and the oblique direction become equal to or greater than 2 cycles of the droplet ejection cycle, then it is possible to form a recorded image of high quality, while landing interference is avoided even in the case where the dots are arranged at high density.

In this way, even in the case of single-pass printing in which a uniform droplet ejection cycle Tf and uniform conveyance speed are maintained, without changing the relative positions of the print head 50 (300) and the recording medium 16, it is possible to ensure prescribed printing conditions without the occurrence of landing interference. If the droplet ejection control in relation to the droplet ejection cycle Tf, the conveyance speed of the recording medium 16, or the like, is changed, then the conditions for deflecting directions of flight of the liquid droplets are also changed accordingly.

Furthermore, one embodiment of the amount of flight deflection (flight angle) is described below. As shown in FIG. 17, the distance z (clearance) between the nozzle formation surface of the print head 50 and the image formation surface of the recording medium 16 is approximately 300 (μm). An angle θ of deflection of an ink droplet is expressed by the following equation, (Formula 15), on the basis of the deflection distance y in the sub-scanning direction in the scanning plane, between ink droplets ejected consecutively from the same nozzle, and the distance z between the nozzle forming surface of the print head 50 and the image formation surface of the recording medium 16.

$$\theta=\arctan(y/z) \qquad \text{(Formula 15)}$$

In other words, if the dot density is 600 dpi, then the minimum dot pitch Pt is 42.2 μm, and if the deflection shift amount k is 4, then the deflection distance y on the scanning plane, in the sub-scanning direction, of ink droplets ejected consecutively from the same nozzle, satisfies "y=(4−1)×42.2 (μm)≅0.127 (mm)", and the angle θ of deflection is approximately 7.2 (degrees).

If the deflection shift amount is 8, then the deflection distance y, in the sub-scanning direction in the scanning plane, of ink droplets ejected consecutively from the same nozzle satisfies "y=(8−1)×42.2 (μm)≅0.295 (mm)", and the angle θ of deflection in this case is 16.4 (degrees).

The present embodiment is described with respect to a full line print head comprising nozzle rows of a length corresponding to the recordable width of the recording medium 16; however, the scope of the present invention is not limited to a full line print head of this kind, and it may also be applied to a shuttle type print head which has a nozzle row of a length shorter than the recordable width of the recording paper and which forms an image on a prescribed region by scanning in the breadthways direction of the recording medium 16. Of these, the present invention is particularly effective in a single-pass shuttle system which completes image formation onto a region scanned by the print head, by means of just one shuttle scanning action.

On the other hand, by reducing the intermittent feed distance of the recording paper to a distance smaller than the print length of the print head in the sub-scanning direction, it is possible to obtain the beneficial effects of the present invention in a system which prints onto the same image region by means of a plurality of scans.

Figure 18:
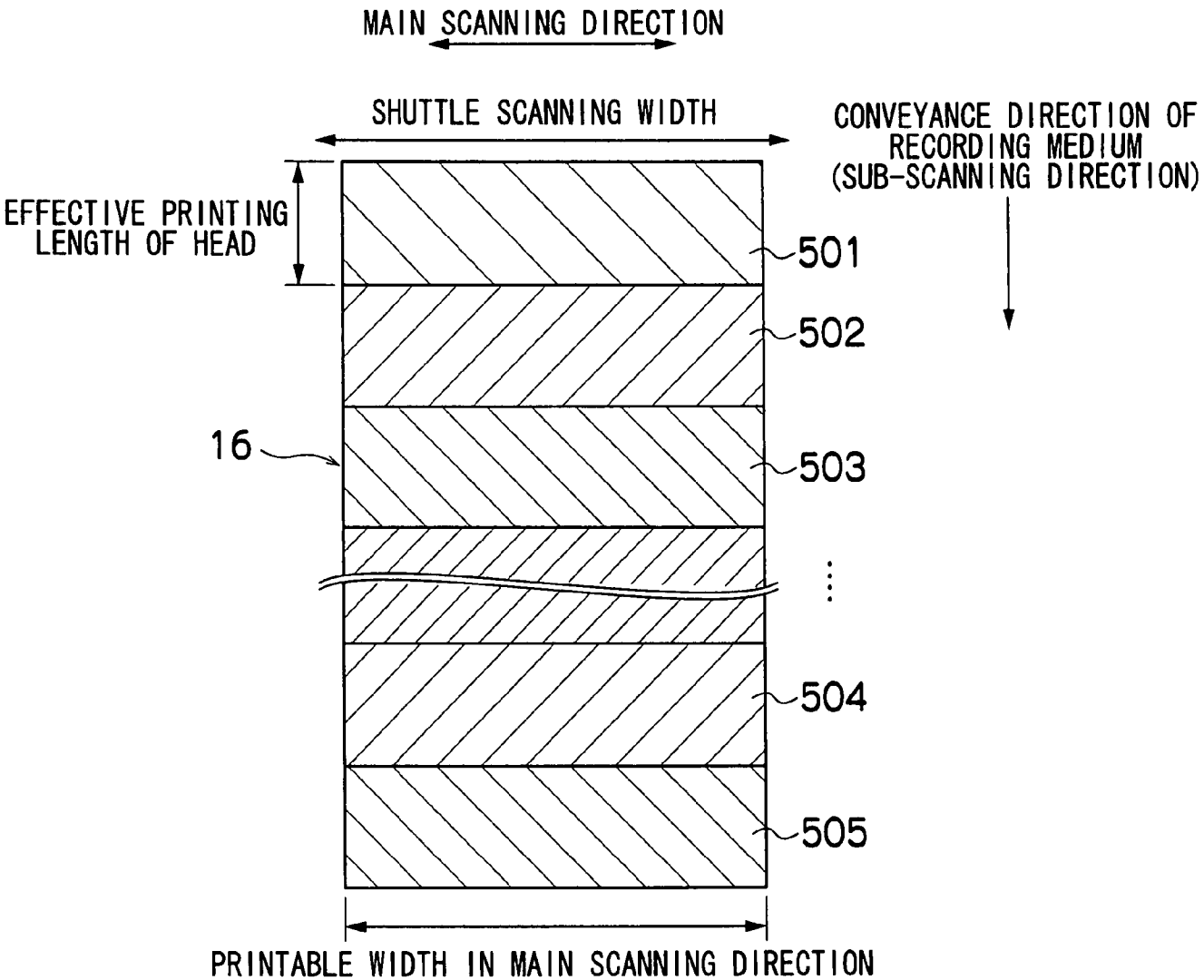
FIG. 18 is a diagram showing droplet ejection control in a shuttle print head.

A method for printing onto a recording medium 16 by means of a single-pass shuttle system is described below with reference to FIG. 18. FIG. 18 shows a print region of the recording medium 16 on which printing is performed by means of a shuttle type print head. As shown in FIG. 18, the shuttle scanning width of the print head (the scanning width in the main scanning direction) is set to be greater than the printable width in the main scanning direction.

In the first shuttle scan, printing is performed onto a region 501. The length of the print region 501 in the sub-scanning direction is approximately the same as the effective printing length of the print head. In the second shuttle scan, printing is performed onto a print region 502, and then printing is performed onto a print region 503. In this way, printing is performed in a progressive fashion, whereby when the print head has performed one scan in the main scanning direction, the print head and the recording medium 16 are moved relatively to each other in the sub-scanning direction.

When printing onto a print region 504 is performed in the i−1th shuttle scan, and printing onto a print region 505 is performed in the ith shuttle scan, then printing have been performed on the whole surface of the recording medium 16 and a desired image have been formed on the recording medium 16.

In one movement in the main scanning direction, printing onto the corresponding print region may be performed in the main scanning direction by moving the print head in one direction, or printing onto the corresponding print region may be performed in the main scanning direction by moving the print head reciprocally, back and forth.

More specifically, it is possible to control printing in such a manner that when printing onto the print region 501 is performed, the pint head is moved in one direction in the main scanning direction (for example, from left to right in FIG. 18), and when printing onto the print region 502 is performed, the print head is moved in the other direction of the main scanning direction (for example, from right to left in FIG. 18).

In a shuttle type print head, a main scanning direction movement device is provided which causes the head and the recording medium 16 to move relatively to each other in the main scanning direction. The main scanning direction movement device may move the print head with respect to the recording medium 16 or it may move the recording medium 16 with respect to a fixed print head. Furthermore, it is also possible to move both the print head and the recording medium 16. Moreover, at borders between adjacent print regions (for example, at the border between the print region 501 and the print region 502), printing is controlled in such a manner that the print regions do not overlap.

In the present embodiment, an inkjet head used in an inkjet recording apparatus is described as an embodiment of a liquid droplet ejection head; however, the present invention may also be applied to an ejection head used in a liquid ejection apparatus which forms images or three-dimensional shapes, such as circuit wiring or machining patterns, by ejecting a liquid (such as water, a chemical solution, resist, or processing liquid) onto an ejection receiving medium, such as a wafer, glass substrate, epoxy substrate.

In the inkjet recording apparatus 10 having the composition described above, the ejection of ink droplets is controlled by deflecting directions of flight of ink droplets ejected consecutively from nozzles provided in the print head 50, through a prescribed angle in the conveyance direction of the recording medium (the sub-scanning direction), in such a manner that the droplet landing time differentials between ink droplets which form dots that are mutually adjacent in the main scanning direction, the sub-scanning direction and the oblique direction are equal to or greater than the partial fixing time To of the ink with respect to the recording medium 16. Therefore, it is possible to obtain a desirable image without the occurrence of landing interference on the recording medium 16, even in the case of high-speed printing in which dots are arranged at high density.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An image forming apparatus, comprising:

a liquid ejection head having a plurality of ejection holes from which liquid droplets are ejected onto a recording medium;

a recording medium conveyance device which causes the liquid ejection head and the recording medium to move relatively to each other, in one direction;

a flight direction deflection device which is capable of deflecting directions of flight of the liquid droplets ejected from each of the ejection holes, in a direction including at least a component of a direction substantially parallel to a relative conveyance direction of the recording medium; and a deflection angle setting device which sets, with respect to each of the ejection holes, two or more angles of deflection with reference to a normal direction to a surface in which the ejection holes are formed and which is on an ejection side, in such a manner that when dots that are adjacent to each other in the direction substantially parallel to the relative conveyance direction of the recording medium are formed in an overlapping fashion, directions of flight of liquid droplets ejected consecutively from each of the ejection holes are deflected so that the directions of flight of the liquid droplets ejected consecutively from each of the ejection holes become different from each other, and a droplet landing time differential between a first liquid droplet and a second liquid droplet which form the dots that are adjacent to each other in the direction substantially parallel to the relative conveyance direction of the recording medium becomes equal to or greater than a quasi fixing time period from a landing time of the first liquid droplet until a time at which the first liquid droplet achieves a quasi fixed state, wherein:

a relationship among a deflection distance y between dots formed on the recording medium by the liquid droplets ejected consecutively from each of the ejection holes, on a scanning plane in the direction substantially parallel to the relative conveyance direction of the recording medium, a minimum dot pitch Pt between dots formed on the recording medium in the direction substantially parallel to the relative conveyance direction of the recording medium, and a deflection shift amount k on the scanning plane of the liquid droplets ejected consecutively from each of the ejection holes (where k is an integer equal to or greater than 2), is expressed as $y=k\times Pt$; and the deflection angle setting device determines the deflection shift amount k and sets the angles of deflection for the ejection holes on the basis of the deflection shift amount k, in such a manner that a relationship, on the scanning plane, among the deflection shift amount k, a droplet ejection cycle Tf of the liquid ejection head, and the quasi fixing time To, satisfies $k \geqq (To/Tf)+1$, and the angles of deflection for the ejection holes from which the liquid droplets are ejected to form the dots that are adjacent to each other in a direction substantially perpendicular to the relative conveyance direction of the recording medium, become different from each other.

2. The image forming apparatus as defined in claim 1, wherein the angles of deflection set for each of the ejection holes include an angle having a component toward an upstream side with reference to the liquid ejection head in the direction substantially parallel to the relative conveyance direction of the recording medium, and an angle having a component toward a downstream side with reference to the liquid ejection head in the direction substantially parallel to the relative conveyance direction of the recording medium.

3. The image forming apparatus as defined in claim 1, wherein the liquid ejection head comprises the plurality of the ejection holes aligned in the direction substantially perpendicular to the relative conveyance direction of the recording medium.

4. The image forming apparatus as defined in claim 1, wherein the deflection angle setting device sets a droplet ejection position shift amount S relating to a relationship $L=Pt\times S$ among a deflection distance L in the direction substantially parallel to the relative conveyance direction of the recording medium between dots formed by liquid droplets landing at substantially simultaneously from the ejection holes in two dot rows which are adjacent to each other in the direction substantially perpendicular to the relative conveyance direction of the recording medium, the minimum dot pitch Pt in the direction substantially parallel to the relative conveyance direction of the recording medium between the dots formed on the recording medium, and a droplet ejection position shift amount S (where S is an integer equal to or greater than 2), and sets the angles of deflection for the ejection holes according to the droplet ejection position shift amount S, in such a manner that a droplet landing time differential between the liquid droplets which form the dots that are adjacent to each other on the recording medium in the direction substantially perpendicular to the relative conveyance direction of the recording medium, becomes equal to or greater than the quasi fixing time of a precedent one of the liquid droplets.

5. The image forming apparatus as defined in claim 4, wherein the deflection angle setting device sets the droplet ejection position shift amount S and sets the angles of deflection for the ejection holes according to the droplet ejection position shift amount S in such a manner that the droplet landing time differential between the liquid droplets which form dots that are adjacent to each other in an oblique direction which is different from the directions substantially parallel to and substantially perpendicular to the relative conveyance direction of the recording medium, becomes equal to or greater than the quasi fixing time of the precedent one of the liquid droplets.

6. An image forming apparatus, comprising:

a liquid ejection head having a plurality of ejection holes from which liquid droplets are ejected onto a recording medium;

a recording medium conveyance device which causes the liquid ejection head and the recording medium to move relatively to each other, in one direction, the ejection holes being aligned in a direction substantially perpendicular to a relative conveyance direction of the recording medium;

a flight direction deflection device which is capable of deflecting directions of flight of the liquid droplets ejected from each of the ejection holes, in a direction including at least a component of a direction substantially parallel to the relative conveyance direction of the recording medium; and a deflection angle setting device which sets, with respect to each of the ejection holes, two or more angles of deflection with reference to a normal direction to a surface in which the ejection holes are formed and which is on an ejection side, in such a manner that when dots that are adjacent to each other in the direction substantially parallel to the relative conveyance direction of the recording medium are formed in an overlapping fashion, directions of flight of liquid droplets ejected consecutively from each of the ejection holes are deflected so that the directions of flight of the liquid droplets ejected consecutively from each of the ejection holes become different from each other, and a droplet landing time differential between a first liquid droplet and a second liquid droplet which form the dots that are adjacent to each other in the direction substantially parallel to the relative conveyance direction of the recording medium becomes equal to or greater than a quasi fixing time period from a landing time of the first liquid droplet until a time at which the first liquid droplet achieves a quasi fixed state, wherein:

the deflection angle setting device sets the angles of deflection for the ejection holes from which the liquid droplets are ejected to form the dots that are adjacent to each other in the direction substantially perpendicular to the relative conveyance direction of the recording medium in such a manner that, the angles of deflection for the ejection holes from which the liquid droplets are ejected to form the dots that are adjacent to each other in the direction substantially perpendicular to the relative conveyance direction of the recording medium, become different from each other;

a relationship between an absolute value $|a\mathbf{1}|$ of an angle $\theta a\mathbf{1}$ of deflection to an upstream side in the relative conveyance direction of the recording medium, set for a first ejection hole of the ejection holes from which the liquid droplets are ejected to form the dots that are adjacent to each other in the direction substantially perpendicular to the relative conveyance direction of the recording medium, and an absolute value $|\theta b\mathbf{2}|$ of an angle $\theta b\mathbf{2}$ of deflection to a downstream side in the relative conveyance direction of the recording medium, set for a second ejection hole of the ejection holes from which the liquid droplets are ejected to form the dots that are adjacent to each other in the direction substantially perpendicular to the relative conveyance direction of the recording medium, satisfies the following equation: $|\theta a\mathbf{1}|=|\theta b\mathbf{2}|$; and a relationship between an absolute value $|\theta a\mathbf{2}|$ of an angle $\theta a\mathbf{2}$ of deflection to the downstream side in the relative conveyance direction of the recording medium set for the first ejection hole, and an absolute value $|\theta b\mathbf{1}|$ of an angle $\theta b\mathbf{1}$ of deflection to the upstream side in the relative conveyance direction of the recording medium set for the second ejection hole, satisfies the following equation: $|\theta a\mathbf{2}|=|\theta b\mathbf{1}|$.

7. The image forming apparatus as defined in claim 6, wherein the deflection angle setting device sets a droplet ejection position shift amount S relating to a relationship $L=Pt\times S$ among a deflection distance L in the direction substantially parallel to the relative conveyance direction of the recording medium between dots formed by liquid droplets landing at substantially simultaneously from the ejection holes in two dot rows which are adjacent to each other in the direction substantially perpendicular to the relative conveyance direction of the recording medium, a minimum dot pitch Pt in the direction substantially parallel to the relative conveyance direction of the recording medium between the dots formed on the recording medium, and a droplet ejection position shift amount S (where S is an integer equal to or greater than 2), and sets the angles of deflection for the ejection holes according to the droplet ejection position shift amount S, in such a manner that a droplet landing time differential between the liquid droplets which form the dots that are adjacent to each other on the recording medium in the direction substantially perpendicular to the relative conveyance direction of the recording medium, becomes equal to or greater than the quasi fixing time of a precedent one of the liquid droplets.

8. The image forming apparatus as defined in claim 7, wherein the deflection angle setting device sets the droplet ejection position shift amount S and sets the angles of deflection for the ejection holes according to the droplet ejection position shift amount S in such a manner that the droplet landing time differential between the liquid droplets which form dots that are adjacent to each other in an oblique direction which is different from the directions substantially parallel to and substantially perpendicular to the relative conveyance direction of the recording medium, becomes equal to or greater than the quasi fixing time of the precedent one of the liquid droplets.

9. A method of controlling droplet ejection in an image forming apparatus including a liquid ejection head, the method of controlling droplet ejection comprising the steps of:

performing a relative movement between the liquid ejection head and a recording medium in one direction; and ejecting liquid droplets from a plurality of ejection holes provided in the liquid ejection head while the relative movement between the liquid ejection head and the recording medium is performed in such a manner that a desired image is formed on the recording medium, wherein two or more angles of deflection with reference to a normal direction to a surface in which the ejection holes are formed and which is on an ejection side are set with respect to each of the ejection holes, in such a manner that when dots that are adjacent to each other in a direction substantially parallel to a relative conveyance direction of the recording medium are formed in an overlapping fashion, a direction of flight of at least one of liquid droplets ejected consecutively from each of the ejection holes is deflected so that directions of flight of the liquid droplets ejected consecutively from each of the ejection holes become different from each other, and a droplet landing time differential between a first liquid droplet and a second liquid droplet which form the dots that are adjacent to each other in the direction substantially parallel to the relative conveyance direction of the recording medium becomes equal to or greater than a quasi fixing time period from a landing time of the first liquid droplet until a time at which the first liquid droplet achieves a quasi fixed state, wherein:

a relationship among a deflection distance y between dots formed on the recording medium by the liquid droplets ejected consecutively from each of the ejection holes, on a scanning plane in the direction substantially parallel to the relative conveyance direction of the recording medium, a minimum dot pitch Pt between dots formed on the recording medium in the direction substantially parallel to the relative conveyance direction of the recording medium, and a deflection shift amount k on the scanning plane of the liquid droplets ejected consecutively from each of the ejection holes (where k is an integer equal to or greater than 2), is expressed as $y=k\times Pt$; and the deflection shift amount k is determined and the angles of deflection for the ejection holes are set on the basis of the deflection shift amount k, in such a manner that a relationship, on the scanning plane, among the deflection shift amount k, a droplet ejection cycle Tf of the liquid ejection head, and the quasi fixing time To, satisfies $k \geqq (To/Tf)+1$, and the angles of deflection for the ejection holes from which the liquid droplets are ejected to form the dots that are adjacent to each other in a direction substantially perpendicular to the relative conveyance direction of the recording medium, become different from each other.

* * * * *